US007334845B2

(12) United States Patent
Peterson et al.

(10) Patent No.: US 7,334,845 B2
(45) Date of Patent: Feb. 26, 2008

(54) COMFORT SURFACE FOR SEATING

(75) Inventors: Gordon J. Peterson, Rockford, MI (US); Kurt R. Heidmann, Grand Rapids, MI (US); Renard G. Tubergen, Alto, MI (US); Christopher J. Norman, Byron Center, MI (US); Bruce M. Smith, Grand Rapids, MI (US); Steven James Beukema, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 265 days.

(21) Appl. No.: 10/846,784

(22) Filed: May 14, 2004

(65) Prior Publication Data

US 2004/0245841 A1 Dec. 9, 2004

Related U.S. Application Data

(63) Continuation-in-part of application No. 10/455,487, filed on Jun. 5, 2003, now Pat. No. 7,226,130.

(51) Int. Cl.
*A47C 7/02* (2006.01)

(52) U.S. Cl. ..... 297/452.63; 297/452.52; 297/452.3

(58) Field of Classification Search ..... 297/452.63, 297/452.3, 452.52, 440.1, 452.51, 452.56, 297/452.54; 5/190, 191; 248/118
See application file for complete search history.

(56) References Cited

U.S. PATENT DOCUMENTS 87,644 A * 3/1869 Daft ..... 297/452.29

(Continued)

FOREIGN PATENT DOCUMENTS

BE 572539 A 7/1962

(Continued)

OTHER PUBLICATIONS

Exhibit A is a print-out from a website "cgi-ebay.com" disclosing an antique chair by designer, Hans J. Wegner, having a back cushion supported by spaced-apart back uprights and apparently having strips extending therebetween.

*Primary Examiner*—David Dunn
*Assistant Examiner*—Tania Abraham
(74) *Attorney, Agent, or Firm*—Price, Heneveld, Cooper, DeWitt & Litton LLP

(57) ABSTRACT

A seating unit includes a perimeter frame, a flexible seating surface supported by the frame, and parallel elongated resilient force-distributing members coupled to the seating surface to control a contour of the seating surface when supporting a seated user. The resilient force-distributing members are bendable along their length and are sufficient in number and distribution to substantially reduce localized deflection of the seating surface and thereby reduce pressure point contact felt by the seated user. The resilient force-distributing members can be wire rods, long strips, or other resilient material with memory. The resilient force-distributing members can be supported on opposing sides of the perimeter frame in various ways to reduce inward pressure on the opposing sides during flexure of the resilient force-distributing members, such as by providing on ends of the resilient force-distributing members one or more rotatable pivots, sliding support at ends of the resilient force-distributing members, stretchable rubber supports, and/or elastic fabric.

82 Claims, 14 Drawing Sheets

U.S. PATENT DOCUMENTS

| | | | | | |
|---|---|---|---|---|---|
| 458,140 | A | * | 8/1891 | Bangs | 297/452.3 |
| 2,156,664 | A | | 5/1939 | Litle, Jr. | |
| 3,035,828 | A | | 5/1962 | Stubnitz | |
| 3,044,831 | A | | 7/1962 | Neely | |
| 3,114,578 | A | * | 12/1963 | Hamilton | 297/452.63 |
| 3,117,775 | A | * | 1/1964 | Hamilton et al. | 267/110 |
| 3,720,568 | A | | 3/1973 | Rowland | |
| 3,843,477 | A | * | 10/1974 | Rowland | 267/111 |
| 4,318,556 | A | * | 3/1982 | Rowland | 297/448.2 |
| 4,769,864 | A | | 9/1988 | Park | |
| 5,320,410 | A | | 6/1994 | Faiks et al. | |
| 5,379,472 | A | | 1/1995 | Aittomaeki | |
| 5,445,436 | A | * | 8/1995 | Kemnitz | 297/452.63 |
| 5,769,500 | A | * | 6/1998 | Holbrook | 297/463.2 |
| 6,056,367 | A | | 5/2000 | Hsiao | |
| 6,074,013 | A | | 6/2000 | Hsiao | |
| 6,099,075 | A | | 8/2000 | Watkins | |
| 6,523,904 | B1 | * | 2/2003 | Vanderminden | 297/452.63 |
| 2003/0001420 | A1 | | 1/2003 | Koepke et al. | |
| 2003/0001424 | A1 | | 1/2003 | Mundell et al. | |

FOREIGN PATENT DOCUMENTS

| | | | |
|---|---|---|---|
| BE | 856830 | A | 10/1977 |
| CH | 142693 | | 10/1930 |
| DE | 834587 | | 3/1952 |
| DE | 29805913 | U | 7/1998 |
| FR | 767099 | A | 7/1934 |
| FR | 883637 | | 7/1943 |
| FR | 54852 | E | 12/1950 |
| FR | 1338211 | A | 9/1963 |
| FR | 2301204 | | 9/1976 |
| GB | 149246 | A | 4/1921 |
| GB | 342613 | A | 2/1931 |
| GB | 483047 | A | 4/1938 |
| GB | 487420 | | 6/1938 |
| GB | 640883 | A | 8/1950 |

* cited by examiner

COMFORT SURFACE FOR SEATING

CROSS REFERENCE TO RELATED APPLICATIONS

The present application is a continuation in part of application Ser. No. 10/455,487, filed Jun. 5, 2003 now U.S. Pat. No. 7,226,130, entitled SEATING WITH COMFORT SURFACE, the entire contents of which are incorporated herein in their entirety by reference. The present application is related to the following applications: Ser. No. 10/792,309, filed Mar. 3, 2004, entitled COMBINED TENSION AND BACK STOP FUNCTION FOR SEATING UNIT, and Ser. No. 10/845,978, filed on even date herewith, entitled SEATING UNIT WITH CROSSBAR SEAT SUPPORT, the entire contents of which are also incorporated herein in their entirety by reference.

BACKGROUND

The present invention relates to seating units having a comfort surface coupled to a framework and constructed to provide comfortable support to a seated user while allowing a reduction in beam strength of the framework. However, the present invention is contemplated to be substantially broader in scope than seating.

Some modern chairs incorporate tensioned fabrics to support a seated user, because tensioned fabrics provide a distinctive appearance, and potentially allow air flow to the seated user for increased comfort. However, a problem with tensioned fabrics is that the tension in the fabric must be great enough to avoid a "hammock-like" feel where the user sinks into and becomes "trapped" within (and experiences side pressure from) the fabric material. While this hammock-like feel may be acceptable for relaxing outdoors, it is not conducive or comfortable in a task chair while trying to do work. The tension required to prevent this "hammock-like" feel is considerable, and accordingly it takes a very strong frame to provide an acceptable amount of strength to adequately tension the fabric. Further, the process of pre-tensioning the fabric in the frame is a more difficult manufacturing step. Also, the frame strength required to support fabric under "high" tension requires mass, strong/heavy/specialized materials, and large cross-sectional sizes, all of which are undesirable in sleek-looking chair designs. However, mass and high-strength specialized materials add to the weight and cost of a product, which is highly undesirable in the competitive furniture industry.

One of the reasons that the frame must be "very strong" is because of engineering dynamics that occur on the perimeter frame members when using tensioned fabrics. When pulled tight, the fabric defines a line between the opposing edges of the fabric (i.e. a line between the side frame members supporting the opposing edges of the fabric). By pressing at a middle point between the opposing edges, a small force on the middle point generates very large inward forces on the opposing edges of the fabric. Thus, when a person sits in the chair, the initial inwardly-directed forces on the opposing perimeter frame sections are very large. The chair frame must be strong enough to resist such large inward forces, both at the instant in time when they are present, and also over time to prevent creep and permanent deformation that occurs over time (and which results in loss of fabric tension). Second, the direction of forces that the opposing perimeter frame sections must generate changes when a person sits in the chair as compared to when the chair is unoccupied. Specifically, when no-one is seated in the chair, the forces define a line parallel the sheet. When a person is seated, the vector forces change to a new direction that is a combination of the seated user's downward weight and the horizontal forces generated to maintain tension in the fabric. In order to adequately withstand the changing vectoral forces (i.e. to withstand the forces and changing directions of those forces), the perimeter frame members must provide sufficient strength and bending strength in all required directions. Hence, the problem of cross-sectional size and beam strength in a given perimeter frame member is not limited to a single direction.

Thus, a system having the aforementioned advantages and solving the aforementioned problems is desired.

SUMMARY OF THE PRESENT INVENTION

In one aspect of the present invention, a seating unit includes a frame, a flexible seating surface supported by the frame, and a plurality of elongated resilient force-distributing members associated with the seating surface to control a contour of the seating surface when supporting a seated user. The resilient force-distributing members are generally flexible and bendable along their length and are sufficient in number and distribution across the seating surface so as to reduce localized deflection of the seating surface. By this arrangement, the resilient force-distributing members reduce point contact pressure associated with the seated user.

In another aspect of the present invention, a comfort surface for a seating unit includes a flexible seating surface. A plurality of elongated resilient force-distributing members are associated with the seating surface to control the contour of the seating surface when supporting a seated user, where the resilient force-distributing members are generally bendable along their length and are sufficient in number and distribution across the seating surface so as to control localized deflection of the seating surface and thereby reduce point contact pressure associated with the seated user.

In another aspect of the present invention, a support structure includes a sheet of material adapted to provide support to a seated user. The sheet material defines a plane including both a first direction and a perpendicular second direction. A plurality of elongated resilient bendable force-distributing members are coupled to the sheet and oriented in the second direction. The sheet material is bendable about second lines parallel the second direction with the resilient force-distributing members distributing forces from point loads into distributed areas that are elongated in the second direction.

In another aspect of the present invention, a support structure for a seating unit includes a plurality of elongated resilient force-distributing members configured to resiliently bend to distribute localized distortion from point loads when supporting a seated user rested against an intermediate portion of the resilient force-distributing members. A support has spaced-apart side frame members supporting the opposing ends. A carrier carries the resilient force-distributing members on the frame members, but decouples the plurality of resilient force-distributing members from the side frame members so that the resilient force-distributing members may be flexed and bent without an equivalent movement of the side frame members.

In another aspect of the present invention, a method of forming a seating unit comprises the steps of providing a frame support structure and assembling a plurality of elongated resilient force-distributing members into a support subassembly, the resilient force-distributing members being generally bendable along their length when flexed. The method further includes attaching the support subassembly to the frame support structure, and attaching a flexible cover over the support subassembly to form a surface to contact the seating unit user.

In another aspect of the present invention, a seating unit includes a frame having opposing frame members defining a space therebetween, and resilient support means adapted to bend and flex for supporting a seated user with distributed support forces even when the seated user generates point loads. Decoupling means are provided for supporting the resilient support means on the frame without undesirably drawing the opposing frame members inwardly when the resilient support means are bent and flexed.

These and other aspects, objects, and features of the present invention will be understood and appreciated by those skilled in the art upon studying the following specification, claims, and appended drawings.

BRIEF DESCRIPTION OF DRAWINGS

FIGS. 16 and 18 showing an unstressed condition of the support structure, and FIGS. 17 and 19 showing a stressed stretched condition;

DETAILED DESCRIPTION OF PREFERRED EMBODIMENTS

The present invention includes a seating unit having a perimeter frame (i.e. seat or back) defining an opening, a flexible seating surface (i.e. a seat surface or back surface for supporting a seated user) supported across the opening by the frame, and parallel elongated resilient force-distributing members coupled to the seating surface to control a contour of the seating surface when supporting a seated user. The resilient force-distributing members are stiff but bendable along their length and are sufficient in number and distribution to substantially reduce localized deflection of the seating surface and thereby reduce pressure point contact felt by the seated user. It is specifically contemplated that the resilient force-distributing members are operably supported on opposing sides of the perimeter frame in various ways to reduce undesirable inward pressure on the opposing sides of the frame during flexure of the resilient force-distributing members from a seated user, such as by providing on ends of the resilient force-distributing members: one or more rotatable pivots, sliding support(s) at ends of the resilient force-distributing members, deformable/distortable rubber support(s), elastic, and/or stretched fabric, and other "decoupling" mechanisms and devices (hereafter as a group referred to as "decoupling means"). By this arrangement, a particularly comfortable seating surface (hereafter also called a "comfort surface") is provided at a relatively low cost and allows a low-cost manufacture. At the same time, a cross-sectional size and strength of perimeter frames can be reduced substantially, since the high inward forces from pressing perpendicularly against the center of a stretched fabric are avoided (see the discussion in the background of the present text). Further, the arrangement is environmentally friendly, since many versions offer the ability to separate and recycle a large percentage of the components.

Figure 1:
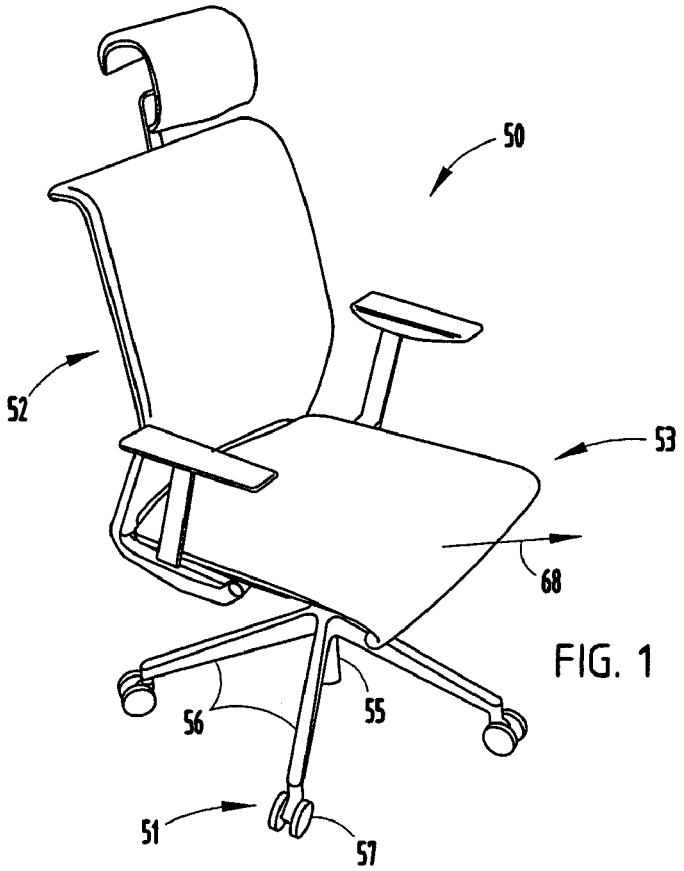
FIGS. 1-2 are front and rear perspective views of a seating unit having a support structure embodying the present invention.
Figure 2:
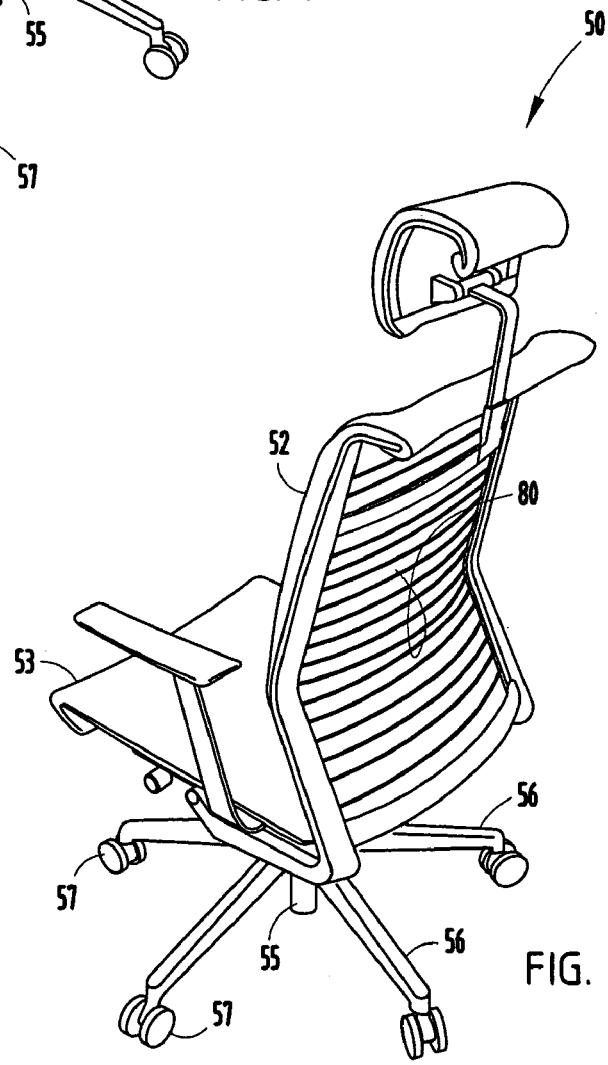

The illustrated seating unit 50 (FIGS. 1-2) is an office chair. Nonetheless, it is specifically contemplated that the present invention could be used on furniture other than chairs, such as couches, benches, and the like, and further can be used on seating other than office seating, such as automotive and mass transportation applications (i.e. automobiles, buses, trains, planes), stadium and auditorium seating, seating for boating and water vehicles, seating for heavy construction vehicles, and in other places where durable comfortable seating is desired. Also, the present invention offers particular and novel support, such that it could be used in packaging and other non-furniture and non-seating applications.

Figure 5:
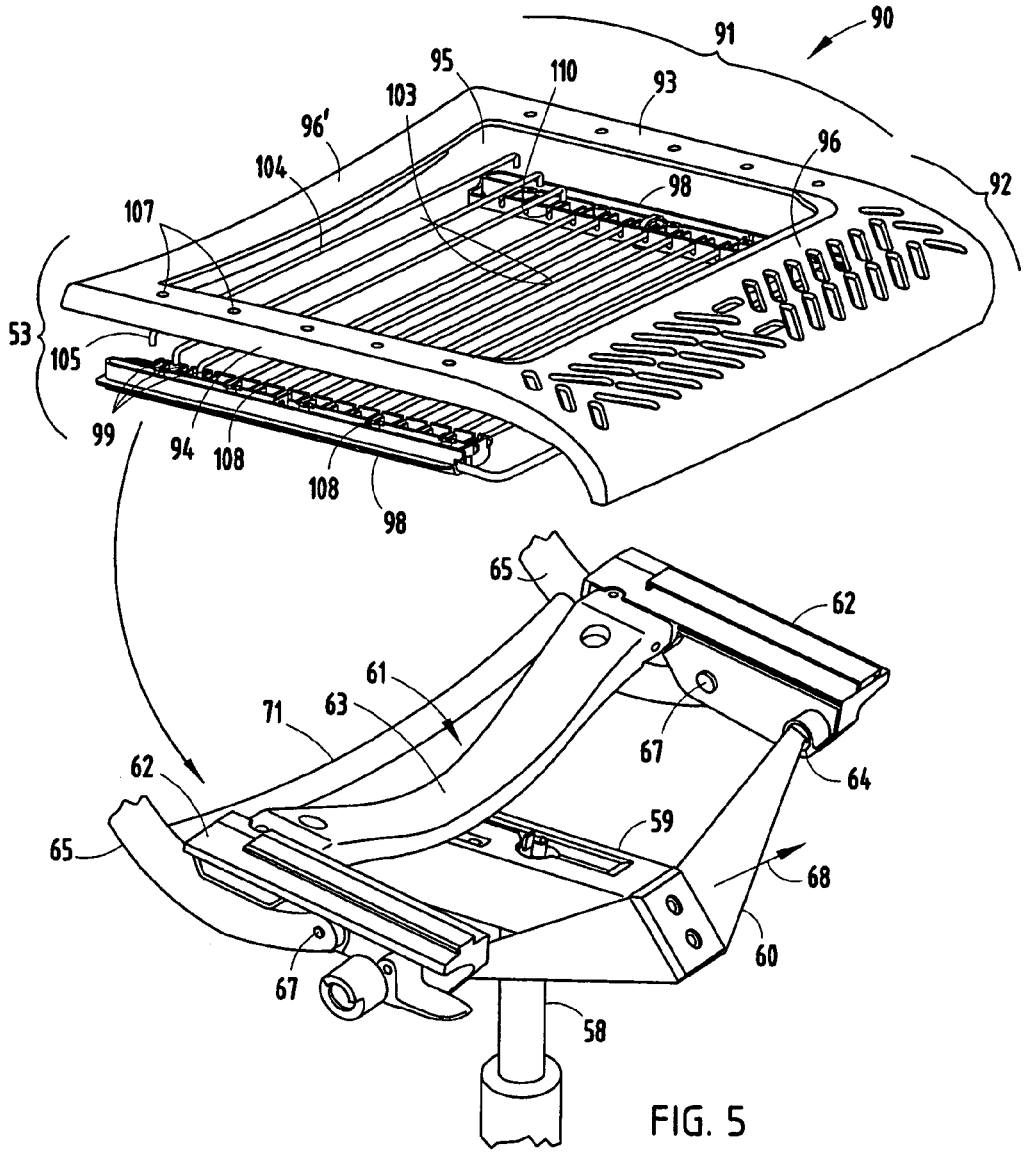
FIG. 5 is an exploded perspective view of the seat shown in FIG. 1.

The seating unit 50 (FIG. 1) includes a base 51, a back 52, and a seat 53 pivoted to the base 51 for synchronized movement upon recline of the back 52. The synchronized motion of the back 52 and seat 53 are adequately disclosed below for an understanding of the present invention, but it is noted that additional detail is included in the pending application Ser. No. 10/792,309, which was incorporated by reference above. The base 51 (FIG. 1) includes a hub 55 with radial legs 56 and castors 57 on each end of the legs 56. A height-adjustable post 58 (FIG. 5) extends upwardly from the hub 55, and engages a central control structure 59. Leaf-spring-like resilient support arms 60 are attached to front and rear ends of the control structure 59. The front and rear resilient support arms 60 are similar in shape and function, with the front arms 60 being angled rearwardly and the rear arms being angled rearwardly. A seat-supporting structure 61 includes side frame members 62 rigidly connected together with a cross bar 63 to form a U-shape in top view. A front of the seat-supporting structure 61 includes pivots 64 for rotatably and slidably engaging the ends of the front resilient support arms 60 (FIG. 5). The back 52 (FIG. 3) includes lower arms 65 that extend downward and forward and that include pivots 66 for rotatably and slidably engaging the ends of the rear resilient support arms 60. The lower arms 65 also include pivots 67 pivotally engaging a side of the side frame members 62. Due to the rearward tilt angle of the front support arm 60 and the forward tilt angle of the rear support arm 60, the seat 53 moves forward and upward in direction 68 (FIGS. 1 and 5) upon rearward recline of the back 52.

The back 52 (FIG. 3) includes a back perimeter frame 69 with top, bottom, and side sections 70-73 defining an open central area (i.e. opening 74). The lower arms 65 extend from the lower ends of the side sections 72-73. The side sections 72-73 (FIG. 4) each define a plurality of pockets 76 that extend parallel each other. The pockets 76 (FIG. 6) open inwardly through a chute 77 (FIG. 4) toward opening 74 across an open radiused or angled surface 78 on inner wall 79. Resilient force-distributing members 80 (illustrated as resilient spring steel wires with round cross sections) each have a linear long section 81 that extends across the opening 74, and also have L-shaped bent ends 82 that fit slidably into one of the pockets 76. A molded cover 83 fits matably onto the side section 72 (and onto section 73) to aesthetically cover the side sections 72-73. The cover 83 includes holes 84 that align with apertured bosses 85 in the side sections 72 and 73 between the pockets 76, for receiving attachment screws 86 to retain the cover 83 to the side frame sections 72-73. An inner wall of the cover 83 includes notches 87 that align with the resilient force-distributing members 80, allowing the resilient force-distributing members 80 to flex and slide without undesired restriction. A length of the resilient force-distributing members 80 and the pockets 76 can be selectively made to permit the resilient force-distributing members 80 to flex without restriction. Alternatively, an inboard end of the pocket 76 (FIG. 6) can be positioned to engage the associated L-shaped bent end 82 to limit inward movement of the end 82. For example, this may be done to avoid the end 82 from sliding completely out of the pocket 76, such as in extreme abuse conditions of the seating unit 50 where substantial weight is placed against the back. Also, the outboard end of the pocket 76 can be positioned to engage the associated L-shaped bent end 82 to limit outward movement of the end 82. For example, this may be done to cause a pretension or pre-curve (see dimension 81') in the long section 81. Testing has shown that users prefer a pretension when initially sitting in a chair and leaning against a back, so that they feel resistance as they are first sitting down into the chair. It is also contemplated that the long section 81 can be pre-bent to have a pre-formed non-linear shape, in order to meet the expectations of a user as they initially lean against the back.

The seat 53 (FIG. 5) includes a perimeter structure 90 having a rear portion 91 and a front portion 92. The rear portion 91 provides primary support to a seated user when they are positioned to a rear of the seat in a "normal" seating position. The rear portion 91 includes side sections 93-94, and front and rear sections 96 and 96' that define an open interior (opening 95). Side frame members 98 abut and are fastened to a bottom of the side sections 93 and 94. The side frame members 98 include a plurality of pockets 99 similar to the pockets 76 described above. Specifically, the pockets 99 open inwardly through a chute toward opening 95 across an open radiused or angled surface on an inner wall of the side sections 93-94. Resilient force-distributing members 103 (illustrated as resilient spring steel wires with round cross sections) each have a linear long section 104 that extends across the opening 95, and also have L-shaped bent ends 105 that fit slidably into one of the pockets 99. The cover for side frame members 98 is the perimeter structure 90, which fits matably onto the side frame members 98. The side sections 93-94 includes holes 107 that align with apertured bosses 108 in the side frame members 98 between the pockets 99, for receiving attachment screws to retain the perimeter structure 90 and the side frame members 98 together. An inner wall of the side frame members 98 includes notches 110 that align with the resilient force-distributing members 103, allowing the resilient force-distributing members 103 to flex, slide, and move without undesired restriction. A length of the resilient force-distributing members 103 and the pockets 99 can be selectively made to permit the resilient force-distributing members 103 to flex without restriction. Alternatively, an inboard end of the pockets 99 can be positioned to engage the associated L-shaped bent end 105 to limit inward movement of the end 105. (See FIG. 6.) For example, this may be done to avoid the end 105 from sliding completely out of the pocket 99, such as in extreme abuse conditions of the seating unit 50. Also, the outboard end of the pocket 99 can be positioned to engage the associated L-shaped bent end 105 to limit outward movement of the end 105. For example, this may be done to cause a pretension or pre-curve in the long section 104. Testing has shown that users may prefer a pretension when initially sitting in a chair so that they feel resistance as they are first sitting down into the chair, though this is perhaps not as critical as in the back 51. It is further contemplated that the long section 104 can be given a pre-bend (such as an arching curve or sling-like curve) or other shape prior to assembly. This provides the comfort surface with a three-dimensional shape which can be more interesting visually than a flat surface. The pre-bend shape can also satisfy some utilitarian functions such as initial feel to a user as they sit down onto the seat. Notably, the pre-assembly bending or post-assembly bending/tensioning can be used on the back as well as the seat, and perhaps is more likely to be used on the back due to the relatively larger deflection desired in the back, particularly in the lumbar region.

Notably, the illustrated perimeter structure 90 is surprisingly flexible and twistable in a direction perpendicular to the top seating surface when it is not attached to the seat-supporting structure 61, but the seat-supporting structure 61 adds considerable strength against twisting-type flexure of the seat. In an unstressed condition (FIG. 5), the L-shaped ends 105 are near an outboard end of the pockets 99. When a seated user rests on the linear sections 104 of the wire resilient force-distributing member 103, the ends 105 are drawn toward each other. Notably, the pockets 99 permit inward movement of the ends 105 without inwardly stressing the opposing sides 93-94 of the perimeter structure 90. (Notably, if the inward movement of the ends 105 were immediately resisted by the perimeter structure 90, there would be substantial force on the perimeter structure 90, due to the mechanical advantage pulling or drawing the ends 105 inward as a straight wire is bent in its middle area.) Because of the reduced strength requirement in the perimeter structure 90, its cross-sectional size can be reduced from chairs where a tensioned fabric is stretched across an opening in a seat frame.

It is contemplated that the resilient force-distributing members can be a variety of different structures, including wire rods, pre-bent wire stock, long leaf-spring-like strips, and/or other resilient material with resilient stiffness and memory. The resilient force-distributing members 103 may have different cross-sectional shapes (e.g. round, flat, curved, I-beam-shaped, oval, obround, etc) and can have a non-uniform cross section and non-uniform strengths along their length. Also, the resilient force-distributing members can be made from a variety of different materials, such as steel, metal, thermoplastic, thermoset plastic, reinforced plastic, and/or composites. Further, the force-distributing members can have a variety of different length shapes, including linear or arching or sling-like or other shapes. The term "wire" is often used herein as a descriptor of the preferred mode, but this phraseology is not intended to be construed as limited to metal.

In operation, a support structure for a seating unit (i.e. the chair 50) includes a perimeter frame (69 or 90) with opposing side sections (72-73 or 93-94) defining an opening (or space), and a flexible comfort surface covering the opening (or space) for supporting a seated user. The comfort surface includes a plurality of elongated resilient force-distributing members (80 or 103) associated with the opening and decoupling means (ends 82/pockets 76 or ends 105/pockets 99) for operably supporting the resilient force-distributing members to reduce localized deflection from point contact and for distributing support for the point contact in a direction of opposing sides of the opening, while also limiting inward forces on the opposing side sections.

Figure 6:
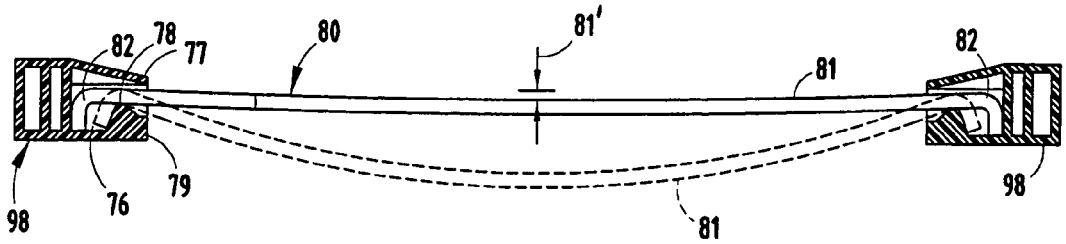
FIG. 6 is a cross-sectional view taken laterally across the seat in FIG. 5 showing ends of the resilient supports being slidably supported by the perimeter seat frame.
Figure 6A:
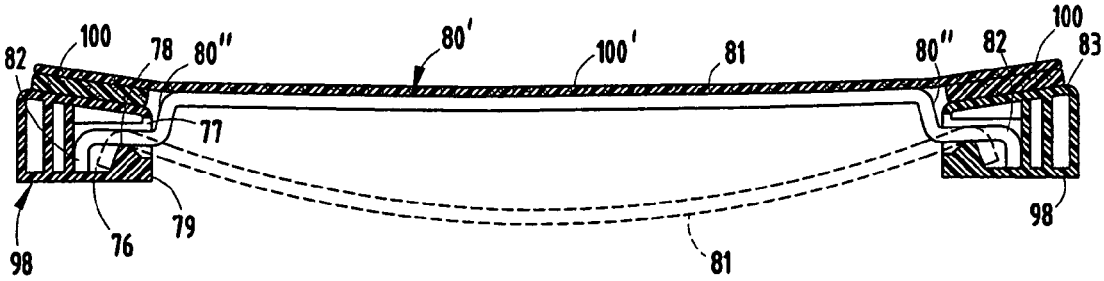
FIG. 6A is a cross-sectional view similar to FIG. 6 but of a modified wire support.
Figure 12:
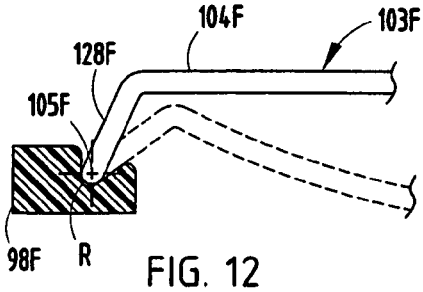
FIG. 12 is an end view of a sixth modified version of a support structure for rotatably supporting the resilient supports embodying the present invention.

FIG. 6A shows an arrangement similar to FIG. 6, but the modified wire support 80' includes an "S" bend 80" located inboard of the chute 77 on each end. The "S" bend 80" positions the straight long section 81 at a raised level relative to the cover 83 and side sections 72 and 73. The raised level can be any distance desired. For example, it may be desirable to position a top surface of the wire section 81 slightly above a top surface of the cover 83. This allows a thicker foam padding 100 to be used on the side frame member 98 and a thinner foam 100' to be used on to cover the long sections 81 of the wire supports 80'. It is noted that thinner foam is desired above the long sections 81 so that the active comfort offered by flexing of the individual wire supports 80' is not masked by the foam. At the same time, thicker foam is desired on the side frame members 98 and generally around the perimeter frame 90 to soften the support received by a seated user on the perimeter frame 90. It is noted that the arrangement shown in FIG. 6A allows the front section 96 of the perimeter frame structure 90 (see FIG. 5) to have a constant horizontal cross section that is linear in a side-to-side direction. Notably, the front section 96 still has a "waterfall" rear edge that curves downwardly adjacent the opening 95, but it does not need to have a lowered center area for transitioning from the front section 96 to the opening 95. Notably, the wire sections 81 flex to provide a very comfortable support, such that a (foam or other) cushion and upholstery (or fabric cover) is potentially not required except perhaps for aesthetics. Notably, the double "S" bend 80" results in there being a leg similar to leg 128D (FIG. 10) or leg 128F (FIG. 12). However, the bend 80" is not long enough to prevent sliding of the L-shaped ends 82 of the wire support 80' in the pockets 76 within the side frame members.

Alternatively, it may be desirable to position the top surface of the wire section 81 at a same level as the cover 83 or slightly below the cover 83, such as if a stretch fabric is used on the cover 83 and/or no foam is used.

Several additional embodiments are disclosed hereafter. Identical and similar features and characteristics are identified using the same numbers but with the addition of the letters "A", "B", "C", etc. This is done to reduce redundant discussion, and not for another purpose. Also, for the purpose of reducing redundant discussion, we will refer to the components of the seat. However, it is contemplated that the same discussion applies to the back.

Figure 3:
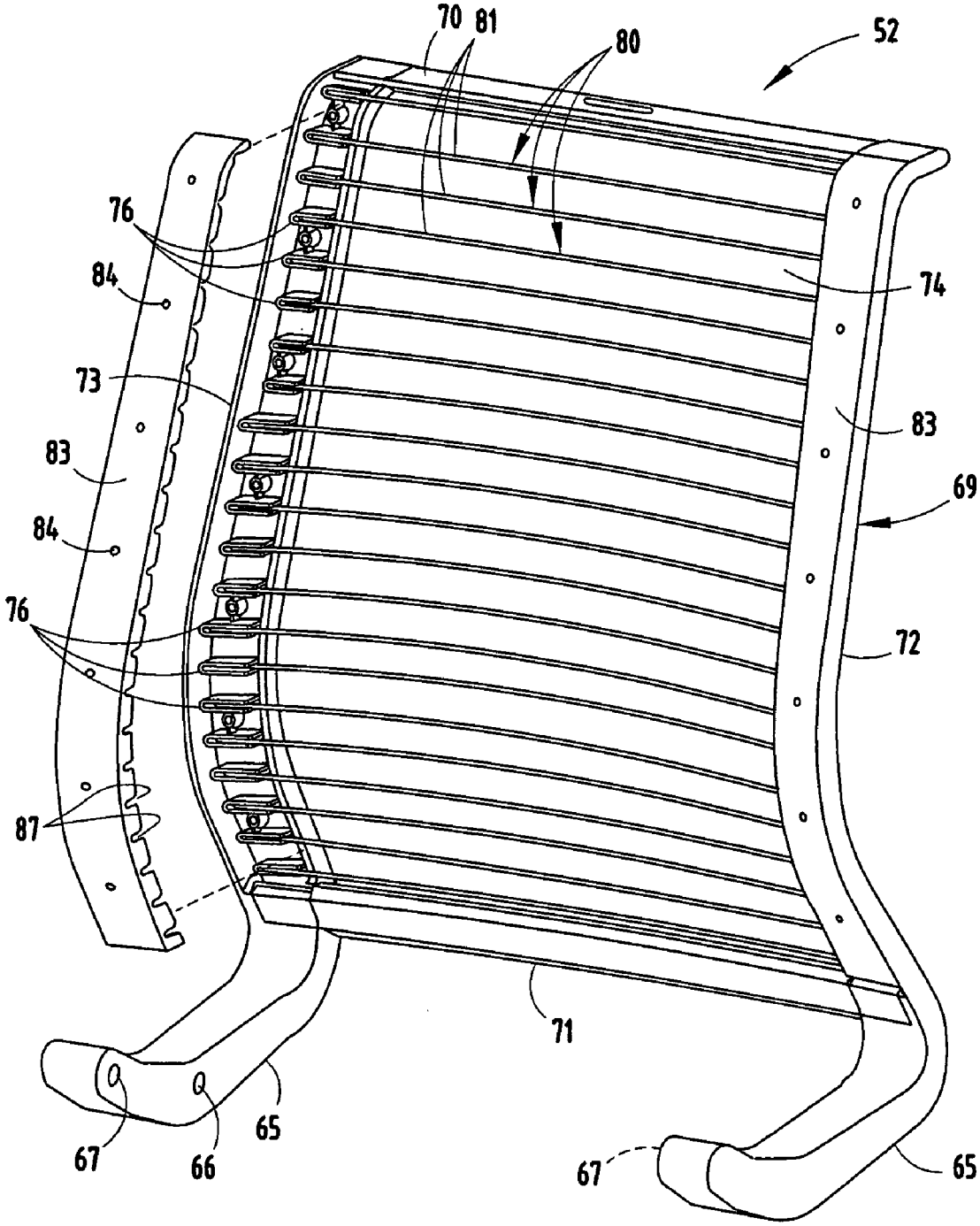
FIG. 3 is a perspective view of the back shown in FIG. 1.
Figure 4:
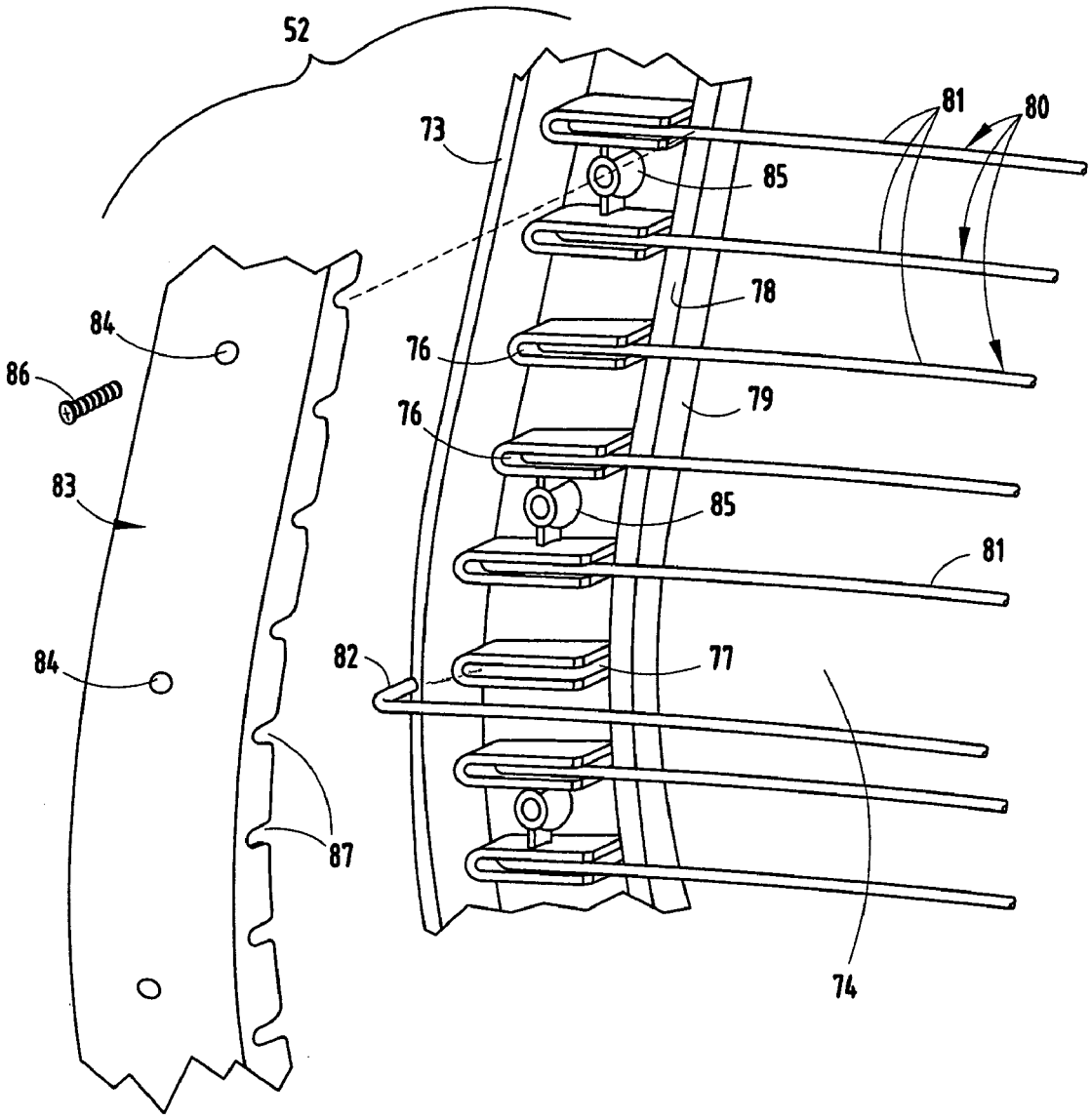
FIG. 4 is an enlarged view of the circled area IV in FIG. 3, with ends of the resilient supports being slidably supported by the perimeter back frame.
Figure 13:
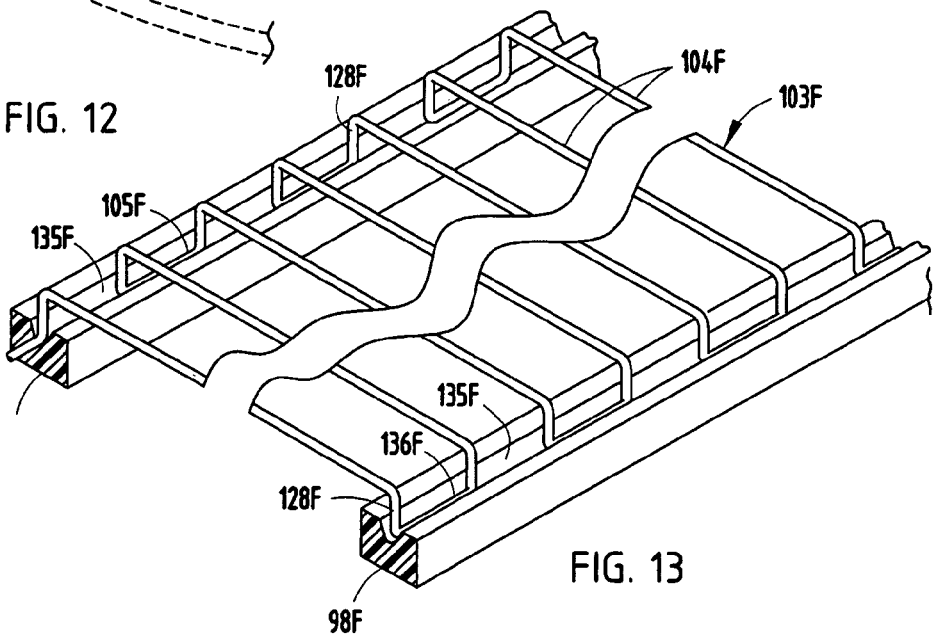
FIG. 13 is a fragmentary perspective view of FIG. 12.

FIGS. 3 and 5 show embodiments of a back and seat using single individual strands of wire with L-shaped ends (see FIG. 6), where each long section (81 or 104) is part of a separate individual wire, and each end section is slidably supported. It is also contemplated that sets of the long sections could be coupled together, such as by forming rectangularly-shaped wire loops 103A (FIG. 7), with each wire loop 103A including a pair of the long sections 104A and including laterally-extending end sections 105A that connect the long sections 104A at each end. One end section 105A is formed as an integral intermediate section of wire between the two long sections 104A, while the other end section can be left as abutting adjacent free end sections, or can be tack-welded together to form a solid continuous rectangular loop of wire. It is further contemplated that more than two adjacent wires could be coupled together, such as by forming a serpentine arrangement from a continuous long strand of wire. For example, the serpentine arrangement would include a first long section, a first end section extending laterally from its first end, a second long section extending from the first end section in a direction parallel the first long section, a second end section extending laterally from its second end, a third long section extending parallel the second long section, a third end section extending laterally from its second long section (at the same end as the first end section), etc. The result would be that each successive long section 104A is connected adjacent long sections at alternating ends. (See FIG. 13.)

Figure 7:
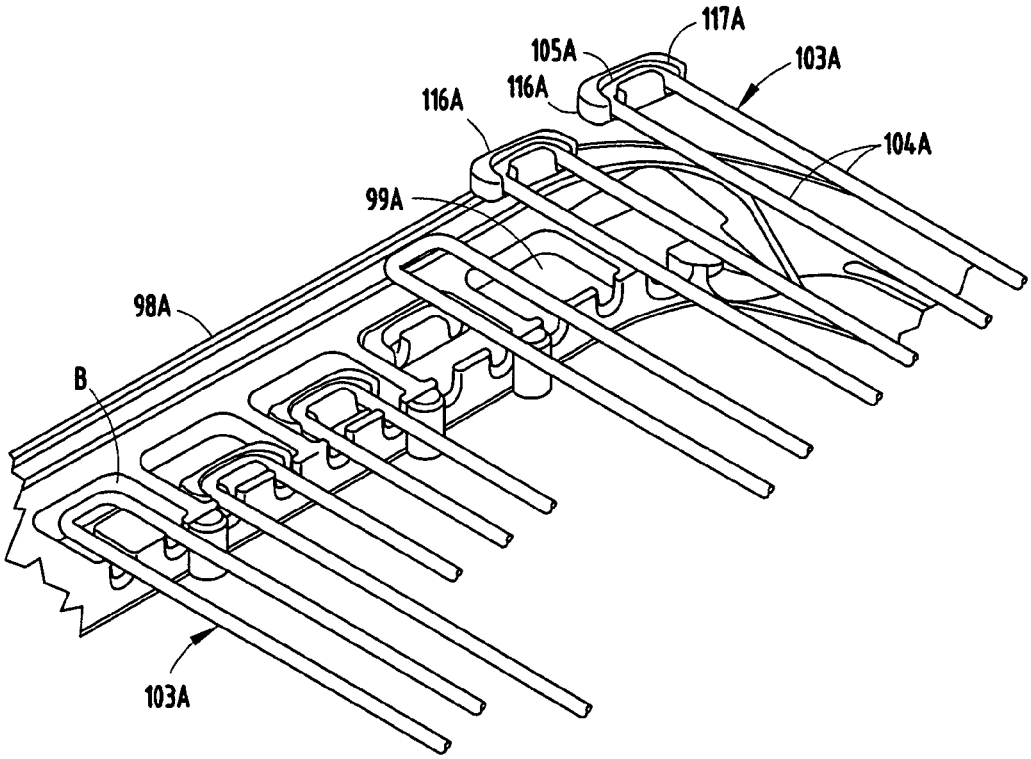
FIGS. 7-9 are side and perspective views of second, third, and fourth modified versions showing sliding support of ends of the resilient supports.
Figure 8:
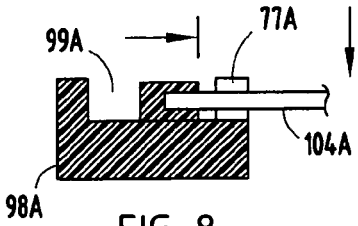

A low-friction bearing can also be used to support the end section for sliding engagement, where further reduction in friction and/or other functional control is desired. For example, bearing 116A (FIG. 7) is adapted to slidably fit into the pocket 99A in side frame member 98A. The bearing 116A includes a U-shaped groove 117A for receiving the end section 105A on loop 103A, and further includes a flat bottom surface for slidably engaging the mating flat bottom surface in the pocket 99A. The groove 117A can be shaped to snappingly receive the end section 105A, if desired. The inboard and outboard surfaces on the bearing 116A are shaped to provide increased surface area to prevent excessive wear and to provide an optimal long-lasting stop for limiting movement of the bearing 116A at its extreme limits of movement, which in turn limits flexure of the long sections 104A, such as may occur in abuse conditions. The bearing 116A can be made of a low-friction material, such as acetal, while the pocket 99A is made from an optimal mating material, such as nylon. FIG. 7 also shows that the rectangular wire loop resilient force-distributing member (see location "B") can be used without the bearing 116A in the same seat construction, if desired.

Figure 9:
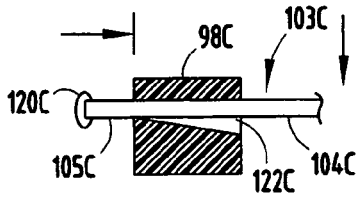

In an alternative embodiment, a single-wire resilient force-distributing member 103C (FIG. 9) includes end sections 105C that extend collinearly with the long section 104C through a side frame member 98C. A stop 120C is formed on an end of the end section 105C, such as by attachment of a secure enlarged ball or washer that will not fit through the hole 121C through which the end section 105C slidably fits. It may be preferred that the hole be enlarged or relieved on its lower inboard surface at location 122C to reduce localized stress on the end section 105C as the long section 104C is flexed and bent during use.

Figure 10:
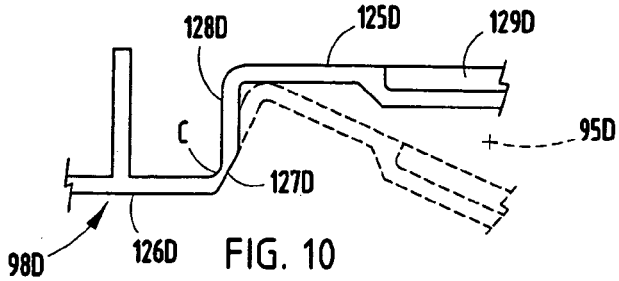
FIG. 10 is an elevational cross-sectional view of a fifth modified version of a support structure embodying the present invention, including an end support member defining a pivot for rotatably supporting an end of the wire-reinforced resilient supports.
Figure 11:
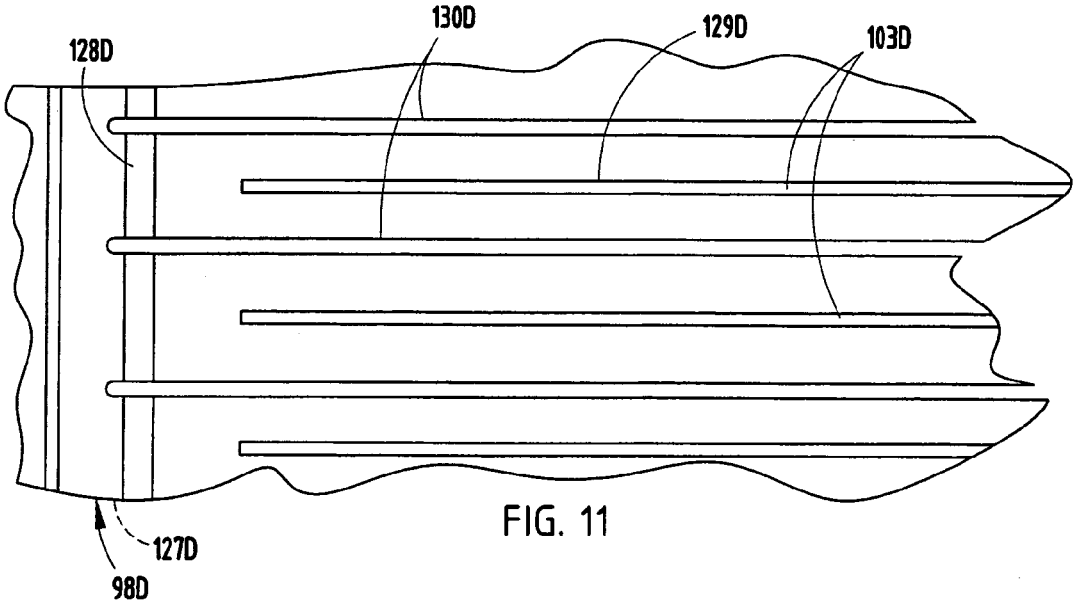
FIG. 11 is a plan view of FIG. 10.

In the embodiment of FIGS. 10-11, the side frame members 98D includes a plurality of adjacent strips of thin flat strips of material 125D connected to the lower wall 126D of the side frame members 98D by living hinges 127D and a vertical leg 128D. Notably, the strips 125D, walls 126D, living hinges 127D and vertical legs 128D can be integrally molded with the side frame members 98D, which reduces part cost and assembly. The strips 125D extend across the opening 95D between the side frame members 98D, and include a groove 129D shaped to snappingly receive the resilient force-distributing members 103D, which are linear and long and without bends. The vertical leg 128D is sufficiently long such that the hinges 127D act as a pivot for rotation about axis "C" when the resilient force-distributing members 103D (i.e. long sections 104D) are flexed, as shown by the dashed lines in FIG. 10. Thus, the embodiment of FIG. 10 is unique in that it does not require any sliding support of the resilient force-distributing member 103D. It is contemplated that the vertical leg 128D could be made slightly shorter, such that there would be a limited flexure of the joint at a top of the vertical leg 128D. This would sacrifice the "pure" rotational support of the resilient force-distributing member since the axis of pivoting motion is "too close" to the end of the resilient force-distributing member 103D, but would potentially not be unacceptable if the other components were adapted to flex and give sufficiently to prevent a seated user from noticing this slight sacrifice in operation. For example, this might be done if a design engineer wanted to make the vertical dimension of the side frame members 98D slightly smaller.

Figure 11A:
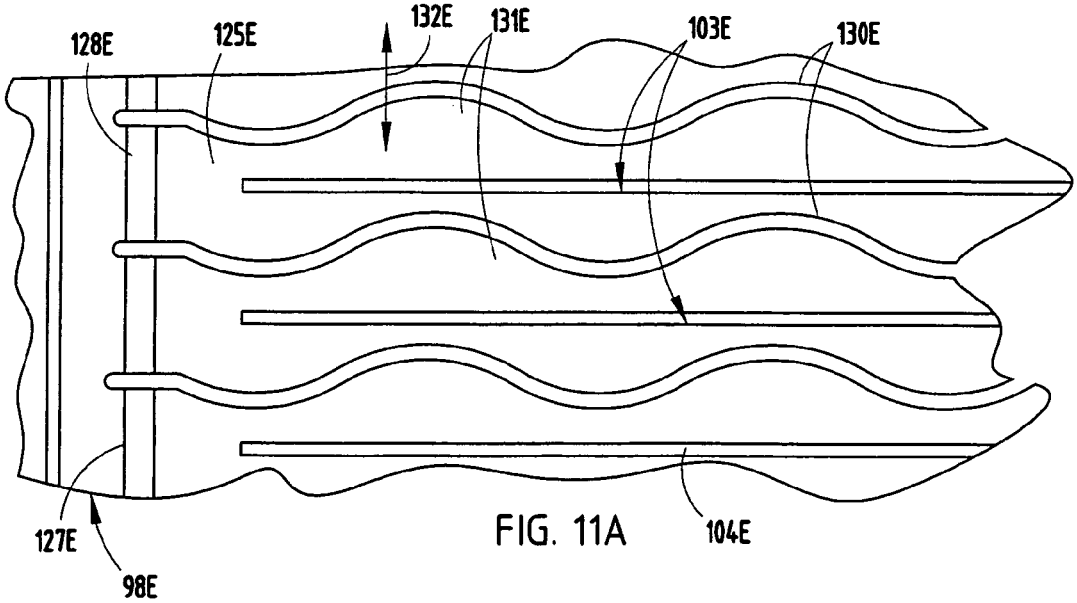
FIG. 11A is a modified version of FIG. 11.

FIG. 11 is a top view of FIG. 10, and illustrates that adjacent strips 125D are separated by linear slits 130D, but that the strips 125D include edges 130D that are relatively close together and parallel. Thus, a seated user does not feel any gap between the strips, even when adjacent strips flex and twist in opposing directions. It is noted that the addition of a cushion and/or upholstery also may help spread forces in a fore-aft direction. FIG. 11A illustrates that the edges 130E can be sinusoidally-shaped to create interfitting finger-like protruding tabs 131E. The protruding tabs 131E provide increased distribution of point loads in a fore-aft direction 132E. They also help assure that a person's clothing does not become pinched between adjacent strips 125D, such as if the arrangement is used without a cushion or upholstery covering. It also prevents the cushion from being trapped therebetween, where a cushion is used. This fore-aft spreading of support complements the function of the long sections of the resilient force-distributing members 103E which spread point contact and distribute point stress in a side-to-side direction parallel a length of the long sections 104E.

An alternative seat 53F (FIGS. 12-13) includes spaced-apart side frame members 98F forming a seating support structure, the side frame members 98F each defining continuous parallel grooves 135F. A serpentine resilient force-distributing member 103F includes several parallel long sections 104F connected together at alternating ends by end sections 105F. The end sections 105F include a vertical leg 128F, and a laterally-extending short section 136F that fits matably into the grooves 135F, where they are rotatably supported. The short sections 136F define axis of rotation at "R" along each of the grooves 135F, and the vertical legs 128F are sufficiently long such that the resilient force-distributing members 103F can flex and bend while being rotatably supported as shown in FIG. 12. Notably, the radius of the wire in the short sections 136F causes a small amount of sliding friction as the short section 136F rotates in the groove 135F, but the radius is so small as to make the sliding resistance negligible. The illustrated vertical leg 128F extends vertically, but it may be angled inwardly slightly, if desired, such that it forms an angle of greater than 90 degrees to the long resilient force-distributing members 103F.

Figure 14:
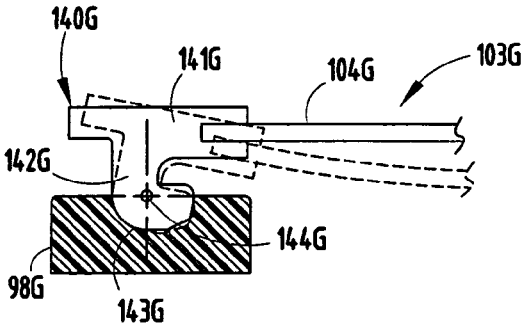
FIG. 14 is an end view of a seventh modified version of a support structure for rotatably supporting the resilient supports embodying the present invention.

Another seating arrangement (FIGS. 14-15) includes spaced-apart side frame members 98G that rotatably support elongated resilient force-distributing members 103G as follows. The resilient support members include a long section 104G and on each end is a molded end piece 140G. The end piece 140G can be molded on, such as by insert-molding, or can be frictionally or otherwise attached. A body 141G of the end piece 140G receives the end of the long section 104G, and a leg 142G extends downwardly from the body 141G. The leg 142G has a radiused bottom surface 143G that forms a sliding pivot surface for slidably engaging a mating groove in the side frame members 98G. It is contemplated that the end piece 140G can be made from a material such as acetal, and the side frame members 98G made from a material such as nylon, such that the friction and wear therebetween is negligible. The end pieces 140G can be secured together by different means. As illustrated, a wire or rod 144G extends along the axis of rotation defined by the radiused bottom surface 143G. This allows the rod 144G to secure the end pieces 140G together in adjacent positions, but allows the end pieces 140G to rotate independently. This preserves the independent action of the resilient force-distributing members 103G. It also allows the end pieces 140G to be attached to each end of the resilient force-distributing member 103G to create a series of modules that can be interconnected in as long of a "sheet" of comfort surface as desired. The modularity of the resilient force-distributing members 103G and their interconnection in series potentially has advantages in manufacturing and assembly.

Figure 17:
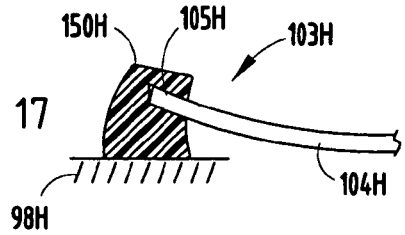

It is conceived that the comfort surface can be formed by a series of resilient force-distributing members 103H with long sections 105H (FIGS. 16-19) coupled together at their outer ends by resilient strips of elastic material 150H, such as rubber or elastomer. The elastic material 150H would in turn be supported by or on side frame members 98H. In the illustrated arrangement, a fabric cover 151H is attached to a side of the side frame members 98H, and extended across the resilient force-distributing members 103H and across the opening 95H to retain the comfort surface and form a more continuous flat surface for aesthetics. When the resilient force-distributing member(s) 103H are flexed, the elastic material 150H stretches and deforms to reduce and substantially eliminate side stress on the side frame members 98H, as illustrated in FIGS. 17 and 19.

Figure 15:
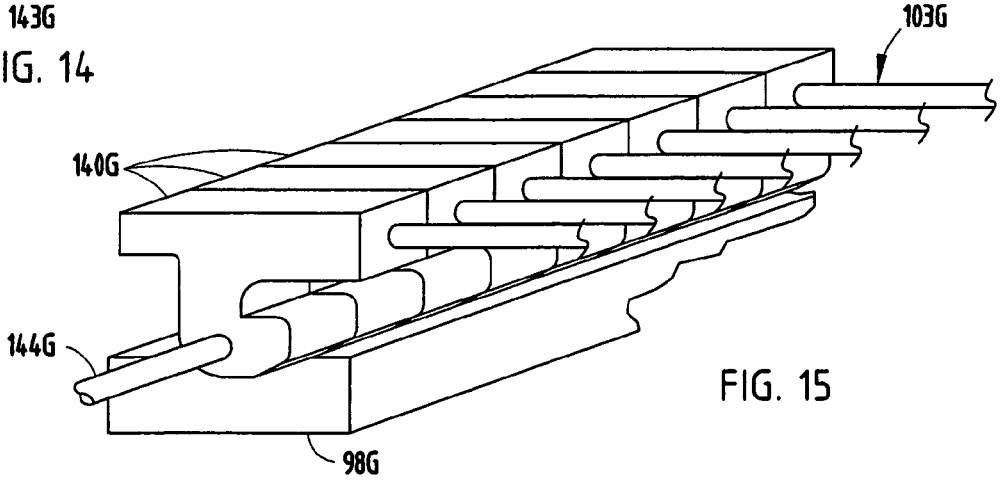
FIG. 15 is a fragmentary perspective view of FIG. 13.
Figure 16:
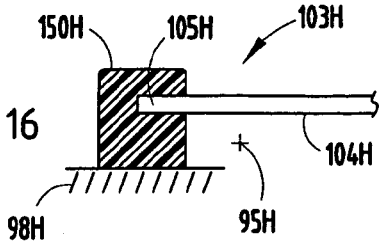
FIGS. 16-17 are end views of an eighth modified version of an elastic support structure for rotatably stretchably supporting the resilient supports embodying the present invention.
Figure 18:
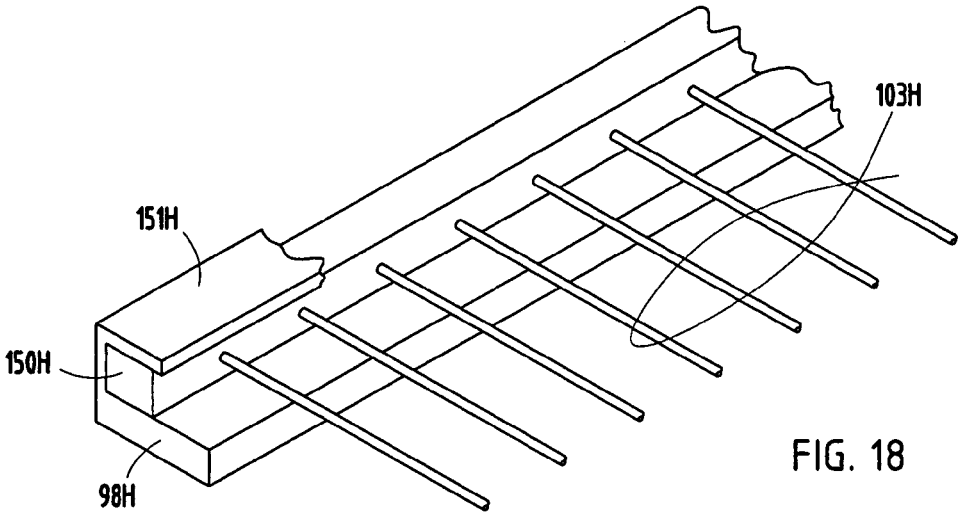
FIGS. 18-19 are perspective views of FIGS. 16-17, respectively.
Figure 19:
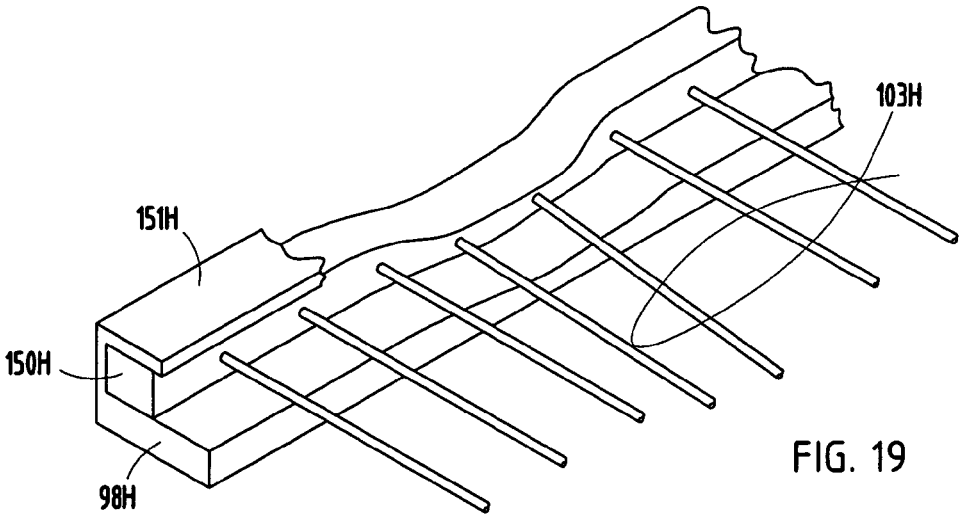
Figure 20:
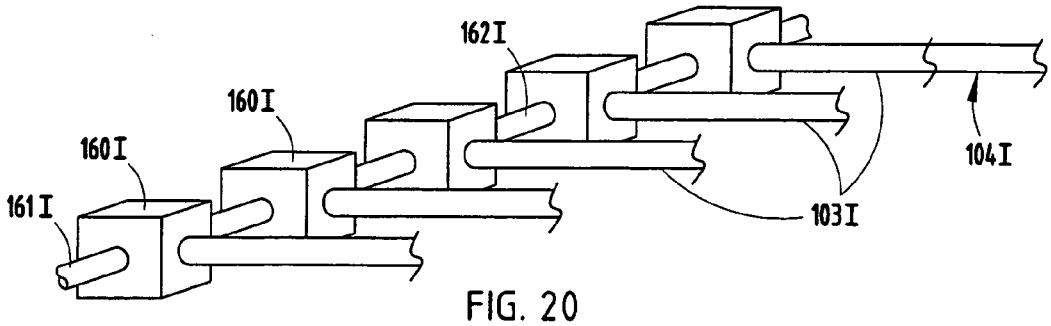
FIG. 20 is an end view of a ninth modified version of a support structure for rotatably supporting the resilient supports embodying the present invention.
Figure 21:
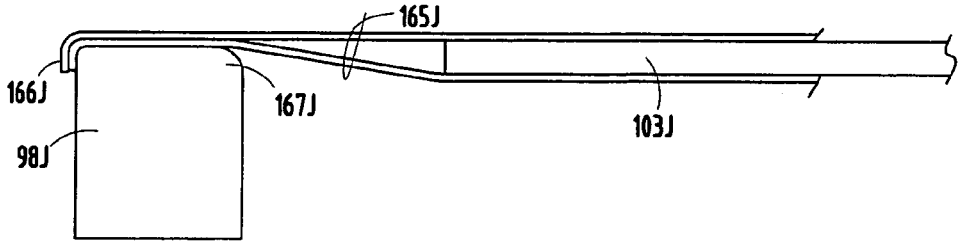
FIGS. 21-22 are end views of a tenth modified version of an elastic support structure for rotatably supporting the resilient supports embodying the present invention.
Figure 22:
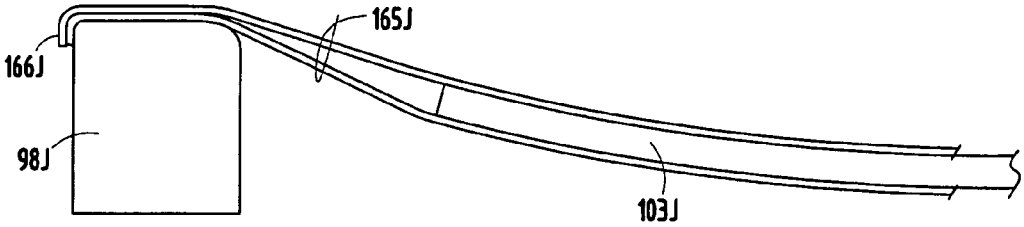
Figure 23:
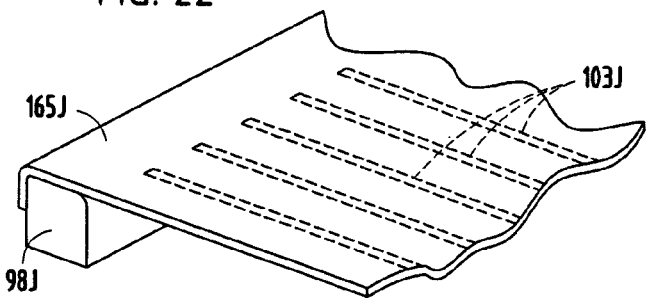
FIGS. 23-24 are perspective views of FIGS. 21-22, respectively, FIGS. 21 and 23 showing an unstressed condition of the support structure, and FIGS. 22 and 24 showing a stressed stretched condition.
Figure 24:
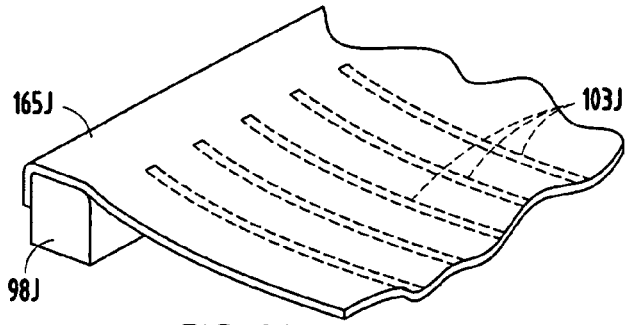

A further modified arrangement is shown in FIG. 20, which is not unlike the embodiment of FIG. 15 and/or FIG. 18. In the comfort surface of FIG. 20, individual modules are made from resilient force-distributing members 103I with blocks 160I secured at each end of the long sections 104I. The blocks 160I are held together by a stiff rod 161I that extends through each of the blocks 160I, and that permits individual rotation of the blocks 160I. The blocks 160I are spaced apart such as by tubular sleeve sections 162I that are positioned on the rods 161I between the blocks 160I. The rods 161I define the axis of rotation for the blocks 160I. The axis of rotation can be equal to or lower than the long sections 104I of the resilient force-distributing members 103I. Where the rods 161I are relatively close in height to the long sections 104I, it may be preferable that the blocks 160I either be made of a material that will stretch and deform, or alternatively, it may be preferable that the resilient force-distributing members 103I slide within the blocks 160I. (Compare to FIG. 9.) In still another modification, the rods 161I are replaced with a flexible cable that spaces the rods 103I apart like beads on a string, and is retained like FIG. 18.

In the modified arrangement of FIGS. 21-24, the comfort surface is provided by sewing or otherwise attaching a series of parallel resilient force-distributing members 103J onto a sheet(s) of material 165J, such as a sheet of upholstery material (or to a sheet of flexible fabric or cushion material). An outer edge 166J of the sheet 165J is secured to the side frame members 98J. The illustrated outer ends of the resilient force-distributing members 103J terminate short of the inboard surface of the side frame members 98J, although it is conceived that they could extend farther outboard than is illustrated. The upholstery sheet 165J is generally drawn tight. An inboard edge 167J of the side frame members 98J is radiused, to provide for a smoother transition of the upholstery sheet 166J as it transitions away from the side frame members 98J. When a person sits on the comfort surface, the resilient force-distributing members 103J distribute stress from any point contact along their lengths. However, it is the upholstery sheet of material that communicates the forces to the side frame members 98J.

Figure 25:
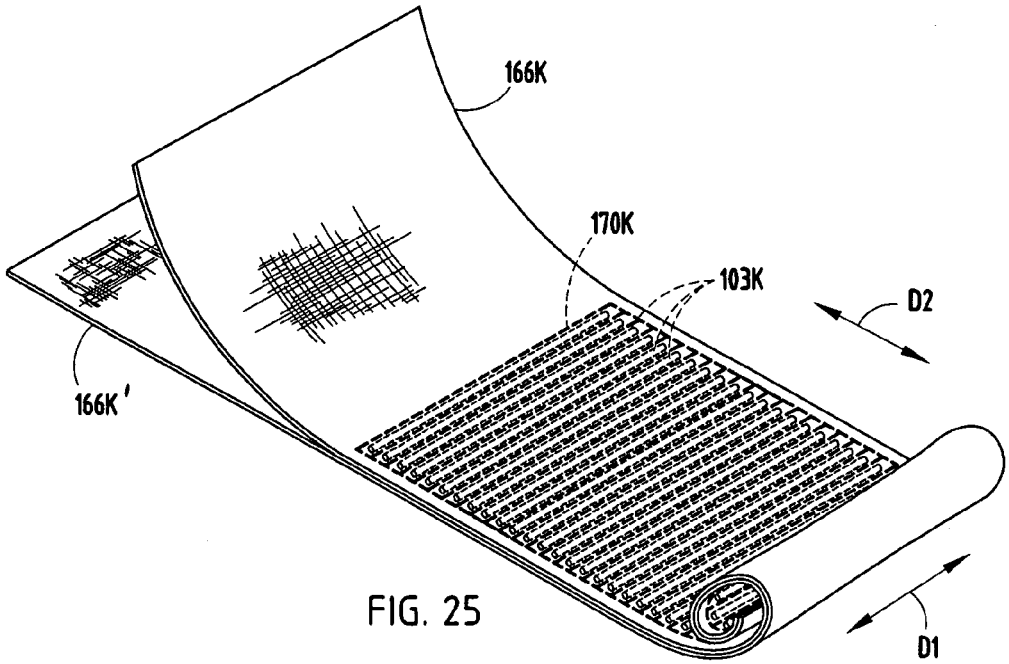
FIGS. 25-26 are perspective views of eleventh and twelfth embodiments comprising rolled sheets incorporating the present invention, FIG. 25 being a pair of upholstery sheets stitched together with parallel resilient force-distributing members therebetween extending between edges, and FIG. 26 being two rubber edge strips bonding and carrying parallel resilient force-distributing members extended therebetween and including a center strip of rubber for stability of the resilient force-distributing members.

In the modified arrangement of FIG. 25, two sheets 166K and 166K' are sewn together, with a plurality of parallel resilient force-distributing members 103K positioned therebetween. The stitching 170K forms pockets within which the resilient force-distributing members 103K are retained. It will be clear to a person skilled in this art that a long strip of "comfort surface" material can be made, and that it can be rolled up into a very long sheet that can be cut off in lengths as desired. This arrangement has particular advantages where a length of the desired "comfort surface" sheet material is not known ahead of time, such as may occur in the packaging industry. It is contemplated that the assembly of sheets 166K/166K' with resilient force-distributing members 103K will form an article that has advantages where edges of the assembly will be supported, but where the sheet assembly requires strength in a first direction D1 and flexibility in a perpendicular second direction D2.

Figure 26:
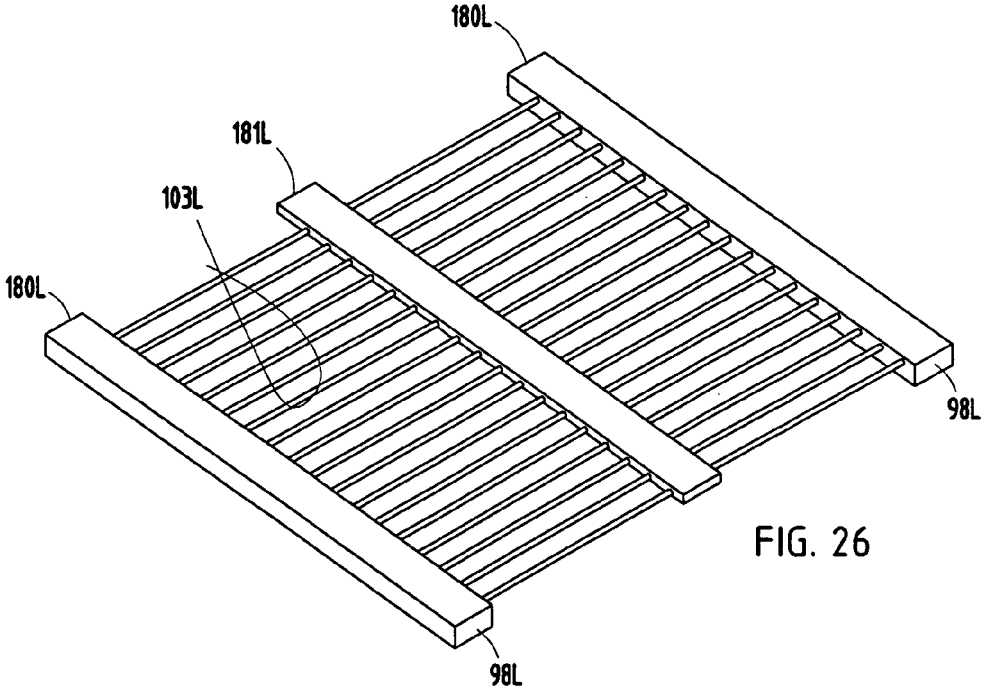

The modified arrangement of FIG. 26 is similar to FIG. 25, but the two sheets 166K and 166K' are replaced with two resilient elastic strips 180L along each end of the resilient force-distributing members 103L for attaching the resilient force-distributing members 103L together in a controlled condition where they can be rolled up. Where desired, a center strip of elastic material 181L can be bonded (or otherwise attached) along a center of the resilient force-distributing members 103L to better control the resilient force-distributing members 103L when the assembly is unrolled and until they are positioned in their use positions on side frame members 98L.

Figure 27:
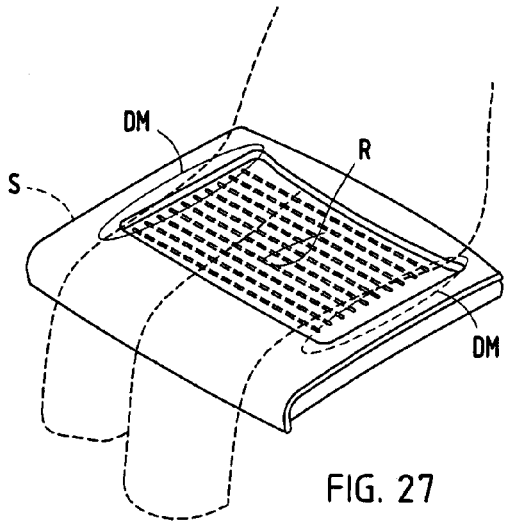
FIG. 27 is a perspective view showing a seated user using a seat like that shown in FIGS. 1-2.
Figure 28:
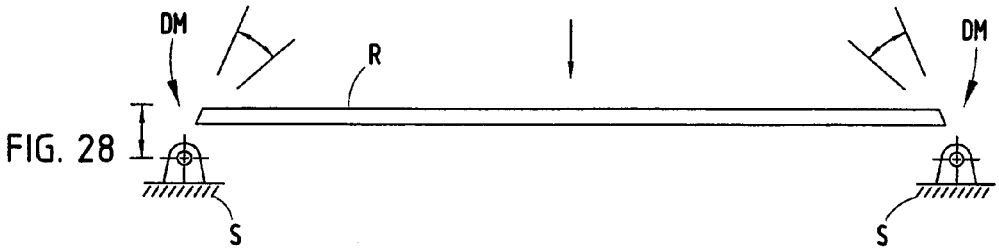
FIGS. 28-29 are schematic views of resilient force-distributing members supported for rotation on their ends.
Figure 29:
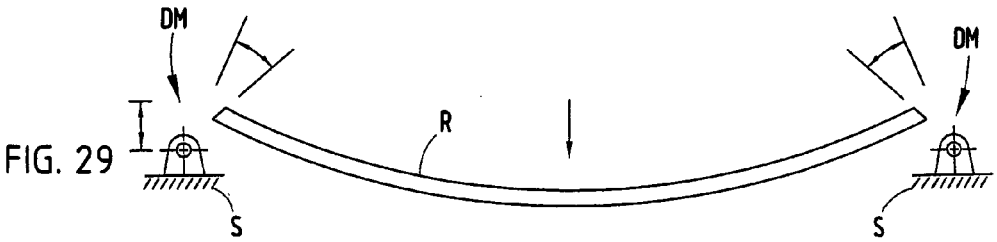
Figure 30:
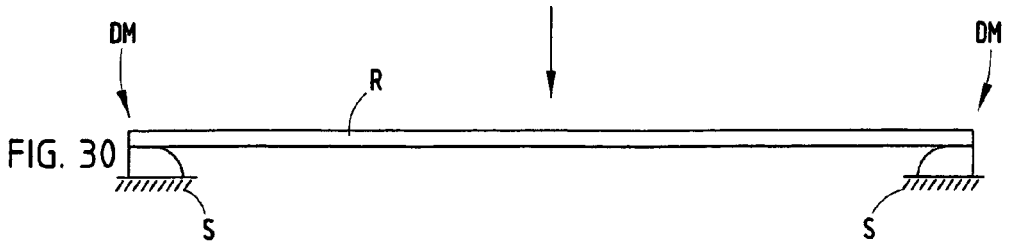
FIGS. 30-31 are schematic views of resilient force-distributing members supported for sliding movement on their ends.
Figure 31:
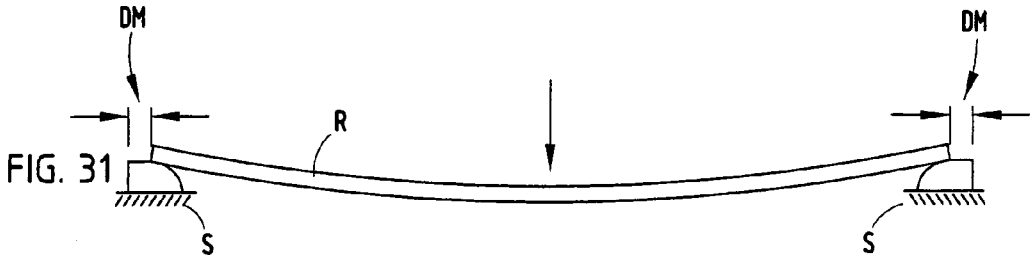
Figure 32:
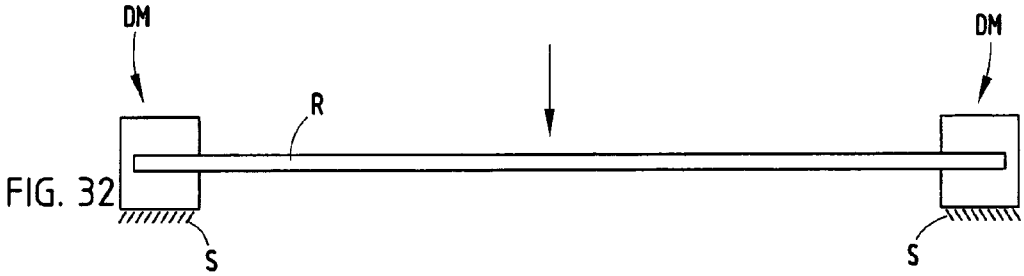
FIGS. 32-33 are schematic views of resilient force-distributing members supported by elastic blocks on their ends.
Figure 33:
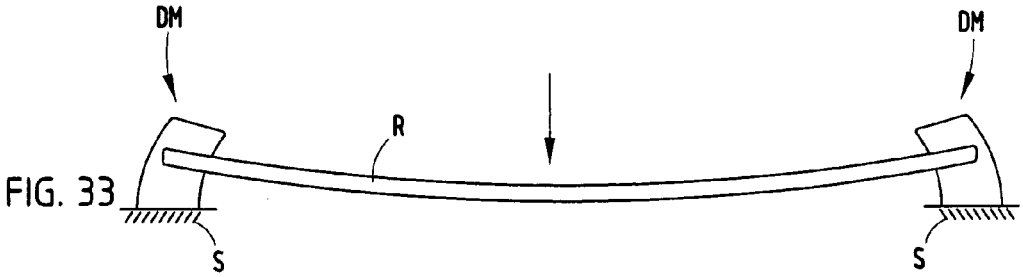

The FIGS. 27-33 are intended to schematically show the present inventive concepts of a resilient force-distributing member R, a support S, and a decoupling means DM, and their interconnection relation. FIG. 27 is a perspective view showing a seated user using a seat like that shown in FIGS. 1-2. It is contemplated that any of the concepts illustrated herein could also be used on a back, a headrest, or an armrest. Further, the present concepts could be used on any seating unit, such as for stadiums, mass transportation, medical, and the like. Still further, the present concepts could be used on any device where it is desirable to distribute point load contact into distributed supporting force. FIGS. 28-29 are schematic views of resilient force-distributing members supported for rotation on their ends; FIGS. 30-31 are schematic views of resilient force-distributing members supported for sliding movement on their ends; and FIGS. 32-33 are schematic views of resilient force-distributing members supported by elastic blocks on their ends. Hybrid arrangements can be made by combining the above concepts. For example, the arrangement of FIGS. 28-29, there is an optimum height, distance, and angle of the pivot arm from the rotation point to the end of support member R. If the pivot arm is too short, tension is created at the joint upon flexure of the support member R. This tension can be avoided by allowing the rotation point to slide or stretch. If the pivot arm is too tall, then the pivot arm is forced to bend upon flexure of member R (unless its support can slide or stretch). If a length of the pivot arm is "just right", neither tension or bending are forced and the linear long section of the wire can flex freely, but only up to a point. The geometry of this relationship is only approximate and breaks down at large deformations.

Figure 34:
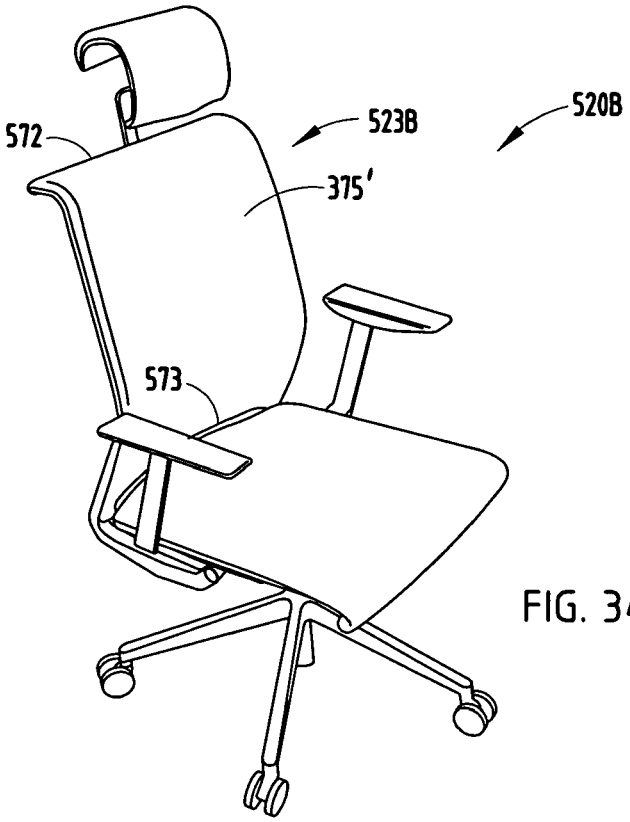
FIGS. 34-35 are front perspective and rear perspective views of a modified form of the present inventive chair.
Figure 35:
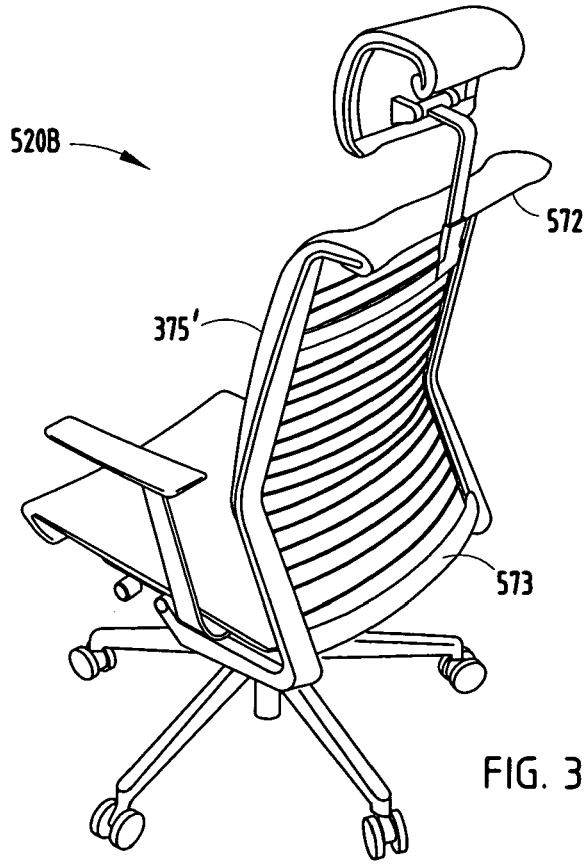
Figure 36:
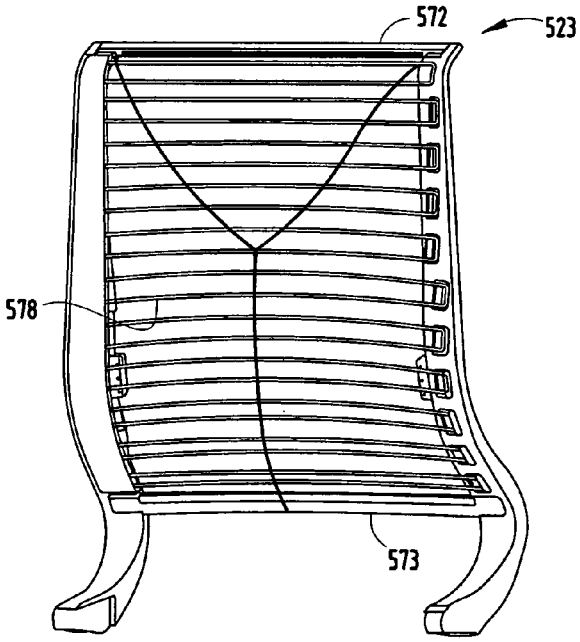
FIGS. 36-37 are front perspective and side views of the back shown in FIG. 34.
Figure 37:
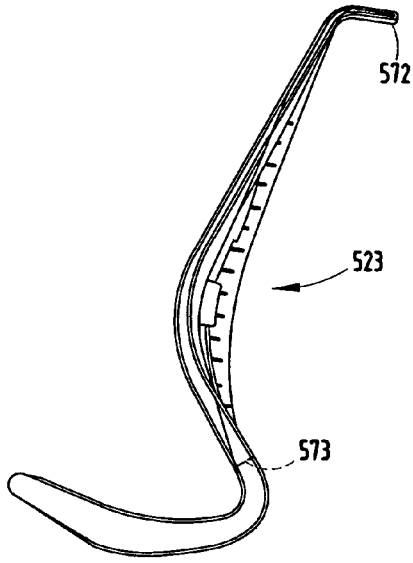

A modified chair 520 is shown in FIGS. 34-35. A top edge of the top frame member 402 shaped rearwardly for increased comfort to a seated user 572 (FIG. 36). Wire strips 583 extend from the top corners of the back frame 570 to a center point located between a seated user's shoulders, and then extend downward into connection to a center of the bottom transverse member 573. When tensioned, the wire strips 583 pretension the wires 551 and cause the comfort surface of the back (i.e. support members 578) to take on an initial concave shape (sometimes referred to as a "PRINGLES potato chip shape"). This concave shape increases the comfort by providing a more friendly "pocket" in the back 523 for a seated user to nest into when they initially sit in the chair 520.

Figure 38:
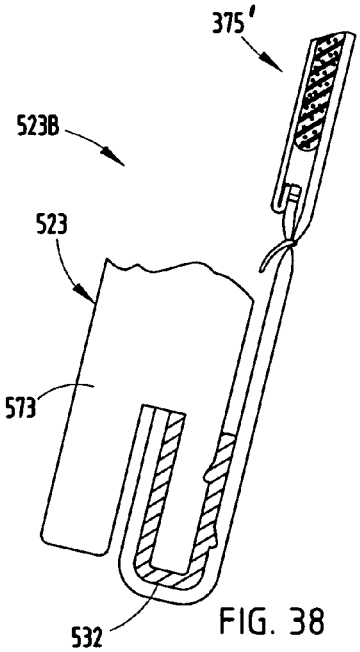
FIGS. 38-39 are cross sectional views showing a bottom attachment configuration for attaching a cushion assembly to the back frame of FIG. 34.
Figure 39:
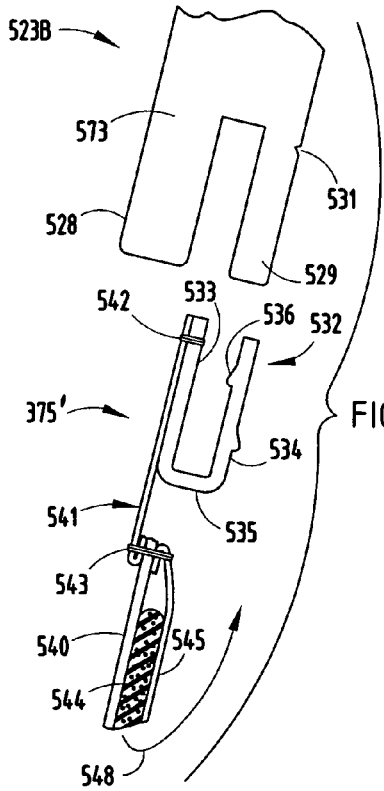

In addition to pretensioning the wire supports as described earlier by abutment against the outboard surfaces of "pocket" (such as pocket 99), the supports can be predetermined in other ways. For example, FIG. 34 shows a cushion assembly 375'. It is contemplated that one optimum method is to stretch and hook attach the cushion assembly to the top and bottom transverse frame sections 572 and 573 (FIG. 36). It is contemplated that a person skilled in the art will be able to use an attachment structure such as shown in FIGS. 38-39 to do so.

The illustrated cushion assembly 375' (FIG. 39) includes a sheet of upholstery material 540 connected to the flat leg 533 by a strip of elastic sheet material 541. (Alternatively, the elastic sheet material 541 can be eliminated, and the upholstery material 540 attached directly to the flat leg 533, if testing shows that the added elastic stretch from the sheet material 541 is not required, see FIG. 38.) Specifically, one edge of the elastic sheet material 541 (FIG. 39) is sewn to the flat leg 533 of clip 532 by stitching 542, and an opposite edge is sewn to the upholstery material 540 by stitching 543. The strip 541 extends completely across a width of the back frame. Different methods are known for attaching and sewing the upholstery material 540 to the strip 541, and of for attaching and sewing the strip 541 to the flat leg 533, such that only a single simple seam is illustrated. It is contemplated that in a preferred form, in addition to the sheet material 541, a foam layer 544 and stable backing sheet 545 will be attached to the cushion assembly 375', although this is not required.

To attach the cushion assembly 375' to the back frame, the flat leg 533 of the extruded clip 532 of the cushion assembly 375' is pressed into the channel 530 of the bottom frame section 573 of the back frame, with the opposing leg 534 frictionally engaging an outer front surface of the bottom frame section. The combined thickness of the elastic sheet material 541 and the flat leg 533 captured within the channel 530, along with the detent protrusion 535 engaging the detent channel 531, form a strong secure connection that retains and holds the cushion assembly 375' to the back frame. It is noted that the sheets 540 and 541 overlay onto the barbed leg 534 when the cushion assembly 375' is fully installed onto the back frame (see the arrow 548 in FIG. 39, and see the assembly of FIG. 38). Since the barbed leg 534 has a thickened cross section, a tension in the sheets 540 and 541 further biases the detent protrusion 535 into engagement with the detent channel 531. Also, the thickened section of the barbed leg 534 can help hide the stitching, by providing a space to receive the stitched area and to receive the multiple thicknesses of pleats in the stitched area.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A seating unit comprising:

a back frame having at least one vertical side section forming a rearwardly concave shape in a lumbar region;

a flexible supporting surface supported by the frame;

a plurality of elongated resilient force-distributing members supported by the frame and having sufficient resilient stiffness to support a seated user when opposing ends of the force-distributing members are supported, the force-distributing members being associated with said supporting surface to control a contour of the supporting surface when supporting the seated user, the resilient force-distributing members being generally flexible and bendable along their length and being sufficient in number and distribution across the supporting surface so as to reduce localized deflection of the supporting surface and thereby reduce point contact pressure associated with the seated user; and a tensioning component associated with the lumbar region of the back frame that engages at least some of the force-distributing members to cause the opposing ends of the some force-distributing members to move horizontally toward each other such that the some force-distributing members thus take on a more curved pretensioned supportive shape.

2. The seating unit defined in claim 1, wherein the at least one vertical side section includes opposing spaced-apart side frame members, and including a decoupling means for slidably supporting the opposing ends of the plurality of resilient force-distributing members on the opposing spaced-apart side frame members.

3. The seating unit defined in claim 2, wherein the at least one vertical side section includes opposing side frame members with a curvilinear shape that force the seating surface to take on a three-dimensional non-planar shape, while still allowing the seating surface to undergo additional movement from external loads.

4. The seating unit defined in claim 2, wherein the seating surface is non-planar and has a three-dimensional ergonomic shape.

5. The seating unit defined in claim 2, wherein the frame engages ends of the force-distributing members to limit a maximum deformation of the comfort surface.

6. The seating unit defined in claim 1, wherein the at least one vertical side section includes opposing spaced-apart side frame members, and including a decoupling means for rotatably supporting the opposing ends of the plurality of resilient force-distributing members on the opposing spaced-apart side frame members.

7. The seating unit defined in claim 1, wherein the at least one vertical side section includes opposing spaced-apart side frame members, and including a decoupling means for movably supporting the opposing ends of the plurality of resilient force-distributing members on the opposing spaced-apart side frame members, the decoupling means including stretchable elastic material supporting the ends of the resilient force-distributing members.

8. The seating unit defined in claim 1, wherein the frame comprises a back perimeter frame defining an opening over which the resilient members are positioned, the perimeter frame including the at least one vertical side section.

9. The seating unit defined in claim 1, including a wire strand with parallel long wire sections forming at least two adjacent ones of the resilient force-distributing members and forming an intermediate section interconnecting the at least two adjacent resilient force-distributing members.

10. The seating unit defined in claim 1, including end pieces attached to the ends of each of the resilient force-distributing members, the end pieces being separate molded components and configured to movably support the ends of the resilient force-distributing members.

11. The seating unit defined in claim 1, wherein the frame has spaced-apart side frame members; and including a carrier carrying the resilient force-distributing members on the frame members; the carrier decoupling the plurality of resilient force-distributing members from the side frame members so that when the resilient force-distributing members are flexed and bent, inward movement of the opposing ends of the resilient force-distributing members are permitted without an equivalent movement of the side frame members.

12. The seating unit defined in claim 1, including bearings on at least some of the ends of the resilient force-distributing members.

13. The seating unit defined in claim 12, including a bearing shoe attached to at least some of the ends of the resilient force-distributing members.

14. The seating unit defined in claim 13, wherein the bearing shoe is made of acetal.

15. The seating unit defined in claim 1, including a carrier engaging the ends of the resilient members and constructed to deform and absorb at least some of the forces caused by inward movement of the ends of the resilient force-distributing members when the resilient force-distributing members are flexed.

16. The seating unit defined in claim 15, wherein the carrier includes a resilient deformable block.

17. The seating unit defined in claim 15, wherein the carrier includes a sheet of material having the resilient force-distributing members attached to the sheet to retain a location of resilient force-distributing members.

18. The seating unit defined in claim 15, wherein the carrier includes a plurality of structural members, one of the structural members being attached to each end of each one of the resilient force-distributing members, and wherein the carrier further includes an interconnecting elongated member that extends parallel the side frame members and extends perpendicular a length direction defined by the resilient force-distributing members for interconnecting all adjacent ones of the structural members.

19. The seating unit defined in claim 15, wherein the resilient force-distributing members comprise transverse sections of a continuous serpentine wire and wherein the carrier includes perpendicular connecting sections of the serpentine wire.

20. The seating unit defined in claim 15, wherein the carrier includes at least one sheet of material holding the resilient force-distributing members in a prearranged pattern.

21. The seating unit defined in claim 20, wherein the at least one sheet includes a sheet of fabric material, with the resilient force-distributing members being energy members that are coupled to the sheet in a parallel pattern.

22. The seating unit defined in claim 1, wherein the resilient force-distributing members are parallel spaced-apart linear components.

23. The seating unit defined in claim 1, wherein the frame comprises a perimeter frame that includes front and rear frame members and that further includes opposing side frame members interconnecting front and rear ends of the front and rear frame members, the opposing side frame members each including one of the at least one vertical side sections.

24. The seating unit defined in claim 1, wherein the at least one vertical side section includes opposite sections with pockets therein, and wherein the force-distributing members include L-shaped ends that slidably engage the pockets for sliding movement upon flexure of the force-distributing members.

25. The seating unit defined in claim 1, wherein the at least one vertical side section includes opposite sections, and wherein the force-distributing members include ends that operably slidably engage opposite sections of the frame and further include S-shaped bends and straight sections that extend between the S-shaped bends, the straight sections being located at elevated positions relative to a top surface of the opposite sections of the frame.

26. The seating unit defined in claim 1, wherein the at least one vertical side section includes a pair of side frame members each having a plurality of recesses that are shaped to slidingly receive the ends of the plurality of force-distributing members, and an abutting surface being an end surface within the recesses.

27. The seating unit defined in claim 26, wherein the side frame members includes an angled surface inboard of each of the recesses for engaging and limiting flexure of the plurality of resilient force-distributing members.

28. The seating unit defined in claim 26, including a cover attached to the frame and covering the recesses to capture the ends of the plurality of resilient force-distributing members therein.

29. The seating unit defined in claim 26, wherein the ends of each of the resilient force-distributing members include L-shaped ends shaped to slidably matably engage individual ones of the recesses.

30. The seating unit defined in claim 26, wherein the recesses each define an opening facing in an inboard direction, the openings being smaller than the recesses and being configured to receive individual ones of the plurality of resilient force-distributing members.

31. A seating unit comprising:

a back frame having at least one vertical side section forming a rearwardly concave shape in a lumbar region;

a flexible supporting surface supported by the frame;

a plurality of elongated resilient force-distributing members associated with said supporting surface to control a contour of the supporting surface when supporting a seated user, the resilient force-distributing members being generally flexible and bendable along their length and being sufficient in number and distribution across the supporting surface so as to reduce localized deflection of the supporting surface and thereby reduce point contact pressure associated with the seated user; and a tensioning component associated with the lumbar section of the back frame that resiliently bends and thus pretensions at least some of the resilient force-distributing members, wherein the at least one vertical side section includes a pair of spaced apart side frame members each with a plurality of recesses formed therein, the tensioning component being formed by an abutting surface on each of the side frame members that abuts an end of the plurality of force-distributing members to cause bending and hence pretensioning of some of the resilient force-distributing members, wherein the resilient force-distributing members have a round cross section.

32. A seating unit comprising:

a back frame having at least one vertical side section forming a rearwardly concave shape in a lumbar region;

a flexible supporting surface supported by the frame;

a plurality of elongated resilient force-distributing members associated with said supporting surface to control a contour of the supporting surface when supporting a seated user, the resilient force-distributing members being generally flexible and bendable along their length and being sufficient in number and distribution across the supporting surface so as to reduce localized deflection of the supporting surface and thereby reduce point contact pressure associated with the seated user; and a tensioning component associated with the lumbar section of the back frame that resiliently bends and thus pretensions at least some of the resilient force-distributing members, wherein the at least one vertical side section includes a pair of spaced apart side frame members each with a plurality of recesses formed therein, the tensioning component being formed by an abutting surface on each of the side frame members that abuts an end of the plurality of force-distributing members to cause bending and hence pretensioning of some of the resilient force-distributing members, wherein the resilient force-distributing members are resiliently stiff steel rods.

33. A seating unit comprising:

a frame having opposing side frame members defining a space therebetween;

resilient support means adapted to bend and flex for supporting a seated user with distributed support forces even when the seated user generates point loads, the resilient support means having opposing ends that are supported by the frame and having sufficient resilient stiffness to support a seated user when the opposing ends of the force-distributing members are vertically supported; and decoupling means for operably supporting the resilient support means on the frame, the decoupling means combining with the frame to provide support to the opposing ends but allowing the opposing ends to move inwardly relative to the opposing side frame members without undesirably forcibly drawing the opposing frame members inwardly when the resilient support means are bent and flexed, the resilient support means including elongated resilient force-distributing members, wherein the decoupling means includes at least one recess that movably support ends of the plurality of resilient force-distributing members on the opposing spaced-apart side frame members for inward movement upon the seated user sitting on the seating unit and further includes surfaces inboard of the recesses for providing additional support to the resilient support means when the resilient force-distributing members are flexed to a predetermined maximum flexed condition.

34. The seating unit defined in claim 33, wherein resilient force-distributing members are generally bendable along their length when flexed, the plurality of resilient force-distributing members being sufficient in number and distribution about the supporting surface so as to substantially reduce localized point deflection of the supporting surface and thereby reduce point pressure contact associated with the seated user.

35. The seating unit defined in claim 33, wherein the decoupling means slidably supports the ends of the plurality of resilient force-distributing members on the opposing spaced-apart side frame members.

36. The seating unit defined in claim 33 wherein the decoupling means slidably supports the ends of the plurality of resilient force-distributing members on the opposing spaced-apart side frame members, the decoupling means including stretchable elastic material supporting the ends of the resilient force-distributing members.

37. The seating unit defined in claim 33, wherein the frame is a back perimeter frame defining an opening over which the resilient force-distributing members are positioned.

38. The seating unit defined in claim 33, including a wire strand forming at least two adjacent ones of the resilient force-distributing members and an intermediate section interconnecting the at least two adjacent resilient force-distributing members.

39. The seating unit defined in claim 33, wherein the resilient force-distributing members have a round cross section.

40. The seating unit defined in claim 33, including end pieces attached to the ends of each of the resilient force-distributing members, the end pieces being separate molded components and configured to movably support the ends of the resilient force-distributing members.

41. The seating unit defined in claim 33, wherein the decoupling means includes a carrier for supporting the ends of the resilient force-distributing members.

42. The seating unit defined in claim 41, wherein the carrier includes a pivot for rotatably supporting the opposing ends on the support.

43. The seating unit defined in claim 42, wherein the pivot is formed integral with the resilient force-distributing members.

44. The seating unit defined in claim 42, wherein the pivot includes a downwardly shaped leg on each of the opposing ends of the resilient force-distributing members.

45. The seating unit defined in claim 42, wherein the pivot includes a plurality of separate components each engaging one of the ends of the resilient force-distributing members.

46. The seating unit defined in claim 42, wherein the pivot includes a plurality of molded-on parts attached to the resilient force-distributing members.

47. The seating unit defined in claim 42, wherein the pivot is integrally molded with the side frame members.

48. The seating unit defined in claim 42, wherein the pivot is between 1-3 inches below a top surface of resilient force-distributing members.

49. The seating unit defined in claim 42, wherein the individual resilient force-distributing members and pivots are separate components interconnected by an elongated connector.

50. The seating unit defined in claim 41, wherein the side frame members include innermost surfaces that are located outboard of the ends of resilient force-distributing members.

51. The seating unit defined in claim 41, including bearings on at least some of the ends of resilient force-distributing members.

52. The seating unit defined in claim 51, wherein the bearings include a plurality of bearing shoes.

53. The seating unit defined in claim 52, wherein the bearing shoes are made of acetal.

54. The seating unit defined in claim 41, wherein the carrier is constructed to deform and absorb at least some of the forces caused by inward movement of ends of resilient force-distributing members.

55. The seating unit defined in claim 54, wherein the carrier includes a resilient block of stretchable material.

56. The seating unit defined in claim 41, wherein the carrier includes a sheet of material with the resilient force-distributing members being attached to the sheet to retain a location of resilient force-distributing members.

57. The seating unit defined in claim 41, wherein the carrier includes a plurality of structural members, one being attached to each end of each one of the resilient force-distributing members, and the carrier further includes an interconnecting elongated member that runs parallel the side frame members and perpendicular a length direction defined by the resilient force-distributing members for interconnecting all adjacent ones of the structural member.

58. The seating unit defined in claim 41, wherein the resilient force-distributing members are transverse sections of a continuous serpentine wire and wherein the carrier includes perpendicular connecting sections of the continuous serpentine wire.

59. The seating unit defined in claim 41, wherein the carrier includes at least one sheet of material holding the resilient force-distributing members in a predetermined position.

60. The seating unit defined in claim 59, wherein the carrier includes a sheet of fabric material, with the resilient force-distributing members being energy members that are coupled to the sheet in desired locations.

61. The seating unit defined in claim 41, wherein the resilient force-distributing members are linear.

62. The seating unit defined in claim 41, wherein the resilient force-distributing members are resiliently stiff rods.

63. The seating unit defined in claim 41, wherein the frame is a perimeter frame, with front and rear frame members connecting front and rear ends of the frame members.

64. The seating unit defined in claim 41, wherein the carrier supports the plurality of resilient force-distributing members on the side frame members and being configured to stretch and compensate in a direction generally parallel the resilient force-distributing members so that when the resilient force-distributing members are flexed and bent, inward movement of the opposing ends is accommodated at least in part by the carrier.

65. The seating unit defined in claim 41, wherein the resilient force-distributing members each have a bending strength and an unstressed shape, and have a memory to return to the unstressed shape when bending stress is removed therefrom; and wherein the decoupling means is a strip of material having edges coupled to the side frame members and carrying the resilient force-distributing members.

66. The seating unit defined in claim 41, wherein the decoupling means is a sheet of material adapted to provide support to a seated user, the sheet material defining a plane including a first direction and a perpendicular second direction, and including a plurality of elongated resiliently bendable resilient force-distributing members coupled to the sheet and oriented in the second direction, the sheet material being bendable about second lines parallel the second direction with the resilient force-distributing members distributing point loads into distributed areas that are elongated in the second direction.

67. The seating unit defined in claim 41, wherein the resilient force-distributing members include opposing ends that terminate short of and are located inboard of the opposing edges.

68. The seating unit defined in claim 33, wherein the frame comprises a back frame having a forwardly-protruding lumbar region.

69. The seating unit defined in claim 68, including a tensioning component shaped to engage, bend, and hence pretension several of the resilient force-distributing members in the lumbar region.

70. The seating unit defined in claim 33, including at least one cover attached to and covering the side frame members, the side frame members including recesses operably supporting the ends of the resilient force-distributing members with the at least one cover closing the recesses except for a plurality of inboard openings through which the plurality of resilient force-distributing members extend.

71. The seating unit defined in claim 70, wherein the inboard openings are smaller than the recesses and wherein the ends of the plurality of resilient force-distributing members are larger than the openings.

72. The seating unit defined in claim 71, wherein the ends of the resilient force-distributing members are L-shaped and positioned to slide within the recesses.

73. A comfort surface for a seating unit comprising:

a flexible supporting surface;

a frame with side frame members defining a plurality of recesses with openings that open in an inboard direction and that are smaller than the recesses; and a plurality of elongated resilient force-distributing members having sufficient resilient stiffness to support a seated user, the force-distributing members including opposing ends movably supported by the side frame members for inward movement when the force-distributing members are bent from the seated user's weight, the force-distributing members being associated with said supporting surface to control the contour of the supporting surface when supporting the seated user, the resilient force-distributing members being generally bendable along their length and being sufficient in number and distribution across the supporting surface so as to reduce localized deflection of the supporting surface and thereby reduce point contact pressure associated with the seated user, the opposing ends of the force-distributing members having bent end portions that extend laterally to restrict movement of the bent end portion through the openings but that permit sliding within the recesses, including spaced-apart side frame members defining a seating area therebetween, the side frame members defining the recesses, and wherein the plurality of resilient force distributing members are positioned with the opposing ends operably supported on the side frame members, including at least one tensioning component that engages and resiliently bends at least some of the force-distributing members to a more curved pretensioned shape.

74. The comfort surface defined in claim 73, including a back frame incorporating the side frame members, the side frame members having a lumbar region with a forwardly-protruding shape.

75. The comfort surface defined in claim 73, including flex-limiting surfaces on the side frame members that engage the resilient force-distributing members when flexed a predetermined amount to limit maximum flexure of at least some of the resilient force-distributing members.

76. A comfort surface for a seating unit comprising:

a flexible supporting surface;

a frame with side frame members defining a plurality of recesses with openings that open in an inboard direction and that are smaller than the recesses; and a plurality of elongated resilient force-distributing members having sufficient resilient stiffness to support a seated user; the force-distributing members including opposing ends movably supported by the side frame members for inward movement when the force-distributing members are bent from the seated user's weight, the force-distributing members being associated with said supporting surface to control the contour of the supporting surface when supporting the seated user, the resilient force-distributing members being generally bendable along their length and being sufficient in number and distribution across the supporting surface so as to reduce localized deflection of the supporting surface and thereby reduce point contact pressure associated with the seated user, the force-distributing members having bent end portions that extend laterally to restrict movement of the bent end portion through the openings but that permit sliding within the recesses, including spaced-apart side frame members defining a seating area therebetween, the side frame members defining the recesses, and wherein the plurality of resilient force distributing members are positioned with the opposing ends operably supported on the side frame members, including flex-limiting surfaces on the side frame members that allow some movement in a direction parallel a length of the elongated resilient force distributing members but that engage the opposing ends of the resilient force-distributing members when flexed a predetermined amount to limit maximum flexure of at least some of the resilient force-distributing members, wherein the recesses in the side frame members are configured to matably slidingly engage ends of the resilient force-distributing members, the flex-limiting surfaces being at an inboard end of the recesses.

77. The comfort surface defined in claim 76, wherein the side frame members include angled surfaces inboard of the recesses that form the flex-limiting surfaces.

78. A comfort surface for a seating unit comprising:

a flexible supporting surface;

a frame including side frame members defining a plurality of recesses with openings that open in an inboard direction and that are smaller than the recesses; and a plurality of elongated resilient force-distributing members having sufficient resilient stiffness to support a seated user; the force-distributing members including opposing ends movably supported by the side frame members for inward movement when the force-distributing members are bent from the seated user's weight, the force-distributing members being associated with said supporting surface to control the contour of the supporting surface when supporting the seated user, the resilient force-distributing members being generally bendable along their length and being sufficient in number and distribution across the supporting surface so as to reduce localized deflection of the supporting surface and thereby reduce point contact pressure associated with the seated user, the force-distributing members having bent end portions that extend laterally to restrict movement of the bent end portion through the openings but that permit sliding within the recesses, including spaced-apart side frame members defining a seating area therebetween, the side frame members defining the recesses, and wherein the plurality of resilient force distributing members are positioned with the opposing ends operably supported on the side frame members, including a cover attached to the side frame members and covering the recesses.

79. The comfort surface defined in claim 78, wherein the opposing ends of the resilient force-distributing members include configured ends captured non-releasably in the recesses by the cover.

80. The comfort surface defined in claim 78, wherein the side frame members and the cover combine to define an opening facing inwardly from each of the recesses, the opening being smaller than the recesses, the ends of the resilient force-distributing members being enlarged and configured to be larger than individual ones of the openings such that the ends cannot move through the openings.

81. The comfort surface defined in claim 80, wherein the ends of the resilient force-distributing members are L-shaped and configured to slide within the recesses.

82. A seating unit comprising:

a back frame having a pair of vertical side sections defining a lumbar region forming a forwardly protruding shape;

a flexible supporting surface supported by the frame; and a plurality of elongated resilient force-distributing members supported by the frame and having sufficient resilient stiffness to support a seated user when opposing ends of the force-distributing members are supported for inward movement when the force-distributing members are bent to support a weight, the force-distributing members being associated with and supporting said supporting surface to control a contour of the supporting surface when supporting a seated user, the resilient force-distributing members being generally flexible and bendable along their length and being sufficient in number and distribution across the supporting surface so as to reduce localized deflection of the supporting surface and thereby reduce point contact pressure associated with the seated user; several of the resilient force-distributing members being resiliently bent and having their opposing ends positioned closer together than other opposing ends such that the several force-distributing members are thus pretensioned to a more curved pretensioned shape different than a remaining number of the resilient force-distributing members, and further having at least one end slidably supported on the side sections to minimize inward pull and stress on the side sections when the seated user is sitting thereon.

* * * * *